US009568221B2

(12) United States Patent
Suhara

(10) Patent No.: US 9,568,221 B2
(45) Date of Patent: Feb. 14, 2017

(54) INDOOR UNIT FOR AIR CONDITIONING DEVICE

(71) Applicant: DAIKIN INDUSTRIES, LTD., Osaka-shi, Osaka (JP)

(72) Inventor: Ryouta Suhara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/777,813

(22) PCT Filed: Mar. 20, 2014

(86) PCT No.: PCT/JP2014/001643

§ 371 (c)(1),
(2) Date: Sep. 17, 2015

(87) PCT Pub. No.: WO2014/178164

PCT Pub. Date: Nov. 6, 2014

(65) Prior Publication Data

US 2016/0138839 A1 May 19, 2016

(30) Foreign Application Priority Data

Apr. 30, 2013 (JP) ..... 2013-095121

(51) Int. Cl.
*F25B 13/00* (2006.01)
*F24F 13/30* (2006.01)
(Continued)

(52) U.S. Cl.
CPC ..... *F25B 13/00* (2013.01); *F24F 1/0007* (2013.01); *F24F 13/30* (2013.01); *F28D 1/0477* (2013.01); *F28F 27/02* (2013.01)

(58) Field of Classification Search
CPC ..... F25B 2339/02; F25B 39/02; F25B 39/028; F28D 1/0417; F28D 1/0443; F28D 1/05325; F28D 7/1615; F28D 7/163; F24F 1/0007; F24F 27/02
(Continued)

(56) References Cited

U.S. PATENT DOCUMENTS 4,053,014 A * 10/1977 Neff ..... B23K 1/0012 165/150
4,089,368 A * 5/1978 Bell, Jr. ..... F28F 9/0275 165/139
(Continued)

FOREIGN PATENT DOCUMENTS

EP 2 444 751 A1 4/2012
JP 58-062469 A 4/1983
(Continued)

OTHER PUBLICATIONS

International Search Report issued in PCT/JP2014/001643, mailed on Jun. 3, 2014.
(Continued)

*Primary Examiner* — Len Tran
*Assistant Examiner* — Gustavo Hincapie Serna
(74) *Attorney, Agent, or Firm* — Birch, Stewart, Kolasch & Birch, LLP

(57) ABSTRACT

An indoor heat exchanger has a first region including a first refrigerant path and a second region including a second refrigerant path. The first refrigerant path forms a full counter flow portion during a heating operation, and forms a full parallel flow portion during a cooling operation. The second region is configured so that air has a lower flow velocity in the second region than in the first region. During both the cooling and heating operations, the second refrigerant path forms both a partial parallel flow portion and a partial counter flow portion.

7 Claims, 11 Drawing Sheets

(51) Int. Cl.
*F24F 1/00* (2011.01)
*F28F 27/02* (2006.01)
*F28D 1/047* (2006.01)

(58) Field of Classification Search
USPC .. 165/122, 123, 124, 125, 126, 150; 62/426, 62/519, 524, 525, 526
See application file for complete search history.

(56) References Cited

U.S. PATENT DOCUMENTS 4,434,843 A * 3/1984 Alford ..... F25B 39/00 165/150
4,995,453 A * 2/1991 Bartlett ..... F25B 39/00 165/150
5,076,353 A * 12/1991 Haussmann ..... F25B 39/04 165/110
5,219,023 A * 6/1993 Kadle ..... B60H 1/3227 165/110
6,116,048 A * 9/2000 Hebert ..... F24F 1/0059 62/524
6,345,667 B1 * 2/2002 Hata ..... F24F 1/0007 165/200
6,382,310 B1 * 5/2002 Smith ..... F28B 1/06 165/121
2004/0118151 A1 * 6/2004 Hebert ..... F25B 39/02 62/524
2006/0168998 A1 * 8/2006 Chin ..... F24F 1/0059 62/515
2008/0035317 A1 * 2/2008 Choi ..... F24F 1/0007 165/122
2008/0141695 A1 * 6/2008 Chae ..... F24F 1/0007 62/259.1
2008/0271473 A1 * 11/2008 Fung ..... A47F 3/0443 62/428
2009/0320504 A1 * 12/2009 Gupte ..... F25B 39/02 62/81
2012/0073786 A1 * 3/2012 Sakashita ..... F24F 1/0007 165/104.14
2012/0145364 A1 * 6/2012 Oritani ..... F24F 1/0007 165/121
2013/0327509 A1 * 12/2013 Michitsuji ..... F24F 13/30 165/172

FOREIGN PATENT DOCUMENTS

JP 63-231123 A 9/1988
JP 2000-304380 A 11/2000
JP 2002-195675 A 7/2002
JP 2007-192442 A 8/2007
JP 2011-122819 A 6/2011
JP WO 2012/114719 * 8/2012 ..... F28F 1/32
WO WO 2012/114719 A1 8/2012

OTHER PUBLICATIONS

Written Opinion issued in PCT/JP2014/001643, mailed on Jun. 3, 2014.

* cited by examiner (HEATING OPERATION)

(COOLING OPERATION)

INDOOR UNIT FOR AIR CONDITIONING DEVICE

TECHNICAL FIELD

The present invention relates to an indoor unit for an air conditioning device, and more particularly relates to paths of refrigerants in an indoor heat exchanger.

BACKGROUND ART

Air conditioning devices for cooling or heating an indoor space have been known. For example, an air conditioning device disclosed in Patent Document 1 includes an indoor unit mounted on a ceiling. The indoor unit includes an indoor fan and an indoor heat exchanger through which air carried by the indoor fan passes.

In an air conditioning device, the flow of a refrigerant in a refrigerant circuit is changed to perform a cooling operation or a heating operation selectively. In the heating operation, a refrigerant compressed by a compressor flows through an indoor heat exchanger of an indoor unit. In the indoor heat exchanger, the refrigerant dissipates heat into indoor air and then is condensed. The condensed refrigerant has its pressure reduced by the expansion valve, and is subsequently evaporated by an outdoor heat exchanger of an outdoor unit. The evaporated refrigerant is sucked into a compressor and compressed therein. In the cooling operation, a refrigerant compressed in the compressor flows through the outdoor heat exchanger of the outdoor unit. In the outdoor heat exchanger, the refrigerant dissipates heat to outdoor air and then is condensed. The condensed refrigerant has its pressure reduced by the expansion valve, and subsequently flows through the indoor heat exchanger of the indoor unit. In the indoor heat exchanger, the refrigerant absorbs heat from the indoor air, and then is evaporated. The evaporated refrigerant is then sucked into the compressor and is compressed therein.

CITATION LIST

Patent Document

PATENT DOCUMENT 1: Japanese Unexamined Patent Publication No. 2011-122819

SUMMARY OF THE INVENTION

Technical Problem

The indoor heat exchanger disclosed in Patent Document 1 includes a plurality of fins and heat transfer tubes running through the fins, and also provided are three tube lines in which the heat transfer tubes are arranged in a direction that intersects with an airflow direction. That is, the indoor heat exchanger is configured as a so-called "cross-fin type heat exchanger." Typically, in such an indoor heat exchanger, a counter flow in which the refrigerant flow is orthogonal to the airflow is generated to improve the heating performance. Accordingly, in the indoor heat exchanger performing a heating operation, the refrigerant flows sequentially from a tube line located most downstream in the airflow direction toward a tube line located most upstream in the airflow direction so that a counter flow portion (a full counter flow portion) is formed across the three tube lines. As a result, in the indoor heat exchanger, some temperature difference is ensured between the refrigerant and the air from the most upstream tube line through the most downstream tube line, and the heating performance is improved.

On the other hand, when such an indoor heat exchanger is performing a cooling operation, the refrigerant flows in the opposite direction from the one during the heating operation so that the refrigerant flows sequentially from the tube line located most upstream in the airflow direction toward the tube line located most downstream in the airflow direction. Accordingly, in the indoor heat exchanger performing a cooling operation, a parallel flow portion (a full parallel flow portion) is formed across the three tube lines. Consequently, in the indoor heat exchanger, the temperature difference between the refrigerant and the air decreases in the most downstream tube line, and thus the cooling performance declines. In particular, in the indoor heat exchanger, the air velocity becomes relatively low, e.g., in a region located inside a drain pan. As a result, in the indoor heat exchanger performing a cooling operation, the heat is not transferred sufficiently between the refrigerant and the air in that region where the air velocity is low, and thus an adequate cooling capacity is not achieved.

In view of the foregoing background, it is therefore an object of the present invention to provide an air conditioning device with an indoor unit which achieves sufficient heating and cooling capacities while striking an adequate balance between them.

Solution to the Problem

A first aspect of the present invention is directed to an indoor unit, provided for a ceiling, for an air conditioning device which selectively performs a cooling operation and a heating operation. The indoor unit includes an indoor fan (27) and an indoor heat exchanger (32) which is disposed around the indoor fan (27) and through which air carried by the indoor fan (27) passes. The indoor heat exchanger (32) includes a plurality of fins (70) and heat transfer tubes (71) running through the fins (70). The indoor heat exchanger (32) includes a plurality of tube lines (L1, L2, L3), the number of which is at least three and in which the heat transfer tubes (71) are arranged side by side in a direction that intersects with an airflow direction. The indoor heat exchanger (32) has a first region (R1) and a second region (R2). The first region (R1) includes a first refrigerant path (81, 82, 83) which forms a full counter flow portion (91) during the heating operation and also forms a full parallel flow portion (92) during the cooling operation. The full counter flow portion (91) allows a refrigerant to flow sequentially from a tube line (L3) located most downstream in the airflow direction toward a tube line (L1) located most upstream in the airflow direction. The full parallel flow portion (92) allows the refrigerant to flow sequentially from the tube line (L1) located most upstream in the airflow direction toward the tube line (L3) located most downstream in the airflow direction. The second region (R2) is configured so that air has a lower flow velocity in the second region (R2) than in the first region (R1) and which includes a second refrigerant path (84, 85). During both the cooling and heating operations, the second refrigerant path (84, 85) forms both a partial parallel flow portion (93) and a partial counter flow portion (94). The partial parallel flow portion (93) allows a refrigerant to flow from the heat transfer tube (71) in any particular one of the plurality of tube lines (L1, L2, L3) toward another tube line located downstream of the particular tube line in the airflow direction. The partial counter flow portion (94) allows the refrigerant to flow from the heat transfer tube (71) in any particular one of the plurality of tube lines (L1, L2, L3) toward another tube line located upstream of the particular tube line in the airflow direction.

In the indoor heat exchanger (32) according to the first aspect of the present invention, formed are the first region (R1) in which air has a relatively high flow velocity and the second region (R2) in which air has a relatively low flow velocity. In the first region (R1), the first refrigerant path (81, 82, 83) is formed. In the second region (R2), the second refrigerant path (84, 85) is formed. In these regions, a refrigerant flowing through each of the refrigerant paths (81-85) exchanges heat with air passing through the indoor heat exchanger (32).

Specifically, during the heating operation, the indoor heat exchanger (32) functions as a condenser. In the first refrigerant path (81, 82, 83) during the heating operation, the refrigerant flows sequentially from the tube line (L3) located most downstream in the airflow direction toward the tube line (L1) located most upstream in the airflow direction so that the counter flow portion (the full counter flow portion (91)) is formed across all the tube lines (L1, L2, L3). Accordingly, in the first region (R1), some temperature difference is ensured between the refrigerant and the air from the tube line (L3) located most downstream through the tube line (L1) located most upstream, and thus the heat exchanger effectiveness increases. On the other hand, in the second refrigerant path (84, 85) during the heating operation, the partial parallel flow portion (93) coexists with the partial counter flow portion (94). During the heating operation, the heat exchanger effectiveness increases in the first region (R1). Thus, even if the partial parallel flow portion (93) is formed in the second region (R2), an adequate heating performance is also achieved.

Meanwhile, during the cooling operation, the indoor heat exchanger (32) functions as an evaporator. In the first refrigerant path (81, 82, 83) during the cooling operation, the refrigerant flows sequentially from the tube line (L1) located most upstream in the airflow direction toward the tube line (L3) located most downstream in the airflow direction so that the parallel flow portion (the full parallel flow portion (92)) is formed across all the tube lines (L1, L2, L3). However, the air has a higher flow velocity in the first region (R1) than in the second region (R2), and thus the heat exchanger effectiveness in the first region (R1) does not significantly decrease. On the other hand, in the second refrigerant path (84, 85) during the cooling operation, the partial counter flow portion (94) is formed. Accordingly, even in the second region (R2) in which the air has a relatively low flow velocity, some heat exchanger effectiveness is still achieved. As a result, the cooling performance is improvable more significantly in the indoor heat exchanger (32) during the cooling operation than in a situation where the parallel flow portion is formed in all the regions.

A second aspect of the present invention is an embodiment of the first aspect of the present invention. In the second aspect, the plurality of tube lines (L1, L2, L3) include a windward tube line (L1) located most upstream in the airflow direction, a leeward tube line (L3) located most downstream in the airflow direction, and an intermediate tube line (L2) located between the windward tube line (L1) and the leeward tube line (L3). During the heating operation, the first refrigerant path (81, 82, 83) forms the full counter flow portion (91) in which the refrigerant flows through the heat transfer tube (71) of the leeward tube line (L3), the heat transfer tube (71) of the intermediate tube line (L2), and the heat transfer tube (71) of the windward tube line (L1) in this order. During the cooling operation, the first refrigerant path (81, 82, 83) forms the full parallel flow portion (92) in which the refrigerant flows through the heat transfer tube (71) of the windward tube line (L1), the heat transfer tube (71) of the intermediate tube line (L2), and the heat transfer tube (71) of the leeward tube line (L3) in this order. During the heating operation, the second refrigerant path (84, 85) forms both the partial parallel flow portion (93) in which the refrigerant flows from the heat transfer tube (71) of the intermediate tube line (L2) toward the heat transfer tube (71) of the leeward tube line (L3) and the partial counter flow portion (94) in which the refrigerant flows through the heat transfer tube (71) of the leeward tube line (L3), the heat transfer tube (71) of the intermediate tube line (L2), and the heat transfer tube (71) of the windward tube line (L1) in this order. During the cooling operation, the second refrigerant path (84, 85) forms both the partial parallel flow portion (93) in which the refrigerant flows through the heat transfer tube (71) of the windward tube line (L1), the heat transfer tube (71) of the intermediate tube line (L2), and the heat transfer tube (71) of the leeward tube line (L3) in this order and the partial counter flow portion (94) in which the refrigerant flows from the heat transfer tube (71) of the leeward tube line (L3) toward the heat transfer tube (71) of the intermediate tube line (L2). During the cooling operation, the refrigerant flows out of the heat transfer tube (71) of the intermediate tube line (L2).

According to the second aspect of the present invention, in the first region (R1) of the indoor heat exchanger (32) during the heating operation, the refrigerant flows through the heat transfer tube (71) of the leeward tube line (L3), the heat transfer tube (71) of the intermediate tube line (L2), and the heat transfer tube (71) of the windward tube line (L1) in this order so that the full counter flow portion (91) is formed. Also, in the second region (R2) of the indoor heat exchanger (32) during the heating operation, formed is the partial parallel flow portion (93) in which the refrigerant flows from the heat transfer tube (71) of the intermediate tube line (L2) toward the heat transfer tube (71) of the leeward tube line (L3), and also formed is the partial counter flow portion (94) in which the refrigerant flows through the heat transfer tube (71) of the leeward tube line (L3), the heat transfer tube (71) of the intermediate tube line (L2), and the heat transfer tube (71) of the windward tube line (L1) in this order.

Also, in the first region (R1) of the indoor heat exchanger (32) during the cooling operation, formed is the full parallel flow portion (92) in which the refrigerant flows through the heat transfer tube (71) of the windward tube line (L1), the heat transfer tube (71) of the intermediate tube line (L2), and the heat transfer tube (71) of the leeward tube line (L3) in this order. Also, in the second region (R2) of the indoor heat exchanger (32) during the cooling operation, formed is the partial parallel flow portion (93) in which the refrigerant flows through the heat transfer tube (71) of the windward tube line (L1), the heat transfer tube (71) of the intermediate tube line (L2), and the heat transfer tube (71) of the leeward tube line (L3) in this order. Also, in the second region (R2) of the indoor heat exchanger (32) during the cooling operation, formed is the partial counter flow portion (94) in which the refrigerant flows sequentially from the heat transfer tube (71) of the leeward tube line (L3) toward the heat transfer tube (71) of the intermediate tube line (L2).

A third aspect of the present invention is an embodiment of the first or second aspect of the present invention. In the third aspect, during the cooling operation, the second refrigerant path (84, 85) forms a flow dividing portion (76, 77) that divides the refrigerant flowed out of the partial parallel flow portion (93) into a plurality of partial counter flow portions (94) including the partial counter flow portion (94).

According to the third aspect of the present invention, in the second refrigerant path (84, 85) of the second region (R2), the refrigerant that has flowed out of the partial parallel flow portion (93) is divided into the plurality of partial counter flow portions (94) via the flow dividing portion (76, 77), and subsequently flows out of the second refrigerant path (84, 85). Accordingly, in the second refrigerant path (84, 85) during the cooling operation, the tube lines (L2, L3) located downstream are provided in parallel with each other. Thus, the pressure loss of the refrigerant is smaller in this case than in the case where these tube lines (L2, L3) are provided in series together.

A fourth aspect of the present invention is an embodiment of any one of the first to third aspects of the present invention. In the fourth aspect, a drain pan (36) is disposed under the indoor heat exchanger (32), and at least part of the second region (R2) of the indoor heat exchanger (32) is located inside the drain pan (36).

According to the fourth aspect of the present invention, at least part of the second region (R2) is located inside the drain pan (36), and thus the flow velocity of the air flowing through the second region (R2) decreases. In this second region (R2), the partial counter flow portion (94) is formed during the cooling operation. Accordingly, the heat exchanger effectiveness increases during the cooling operation, and thus the cooling performance is improvable.

Advantages of the Invention

According to the present invention, during the heating operation, the first refrigerant path (81, 82, 83) in the first region (R1) forms the full counter flow portion (91), and the second refrigerant path (84, 85) in the second region (R2) forms the partial counter flow portion (94). Thus, some temperature difference is ensured more easily between the refrigerant and the air over the entire region. As a result, in the indoor heat exchanger (32), a relatively high heating capacity is achieved.

Also, according to the present invention, in the second region (R2) in which the air has a relatively low velocity, the partial counter flow portion (94) is formed during the cooling operation. Thus, the heat exchanger effectiveness increases in the second region (R2) compared to the case where the parallel flow portion is formed over the entire second region (R2). As a result, during the cooling operation, the heat transfer between the refrigerant and the air is promoted in the second region (R2), and the cooling performance is improvable.

According to the second aspect of the present invention, in the indoor heat exchanger (32) including the three tube lines (L1, L2, L3), a refrigerant path having the advantages of the first aspect of the present invention is implementable.

According to the third aspect of the present invention, the pressure loss in the second refrigerant path (84, 85) is reducible during the cooling operation. As a result, the power dissipated during the cooling operation is prevented from increasing due to an increase in pressure loss. Also, a reduction in pressure loss in the second refrigerant path (84, 85) prevents the refrigerant from drifting only to the first refrigerant path (81, 82, 83). Accordingly, a sufficiently high flow rate is ensured for the refrigerant flowing through the second refrigerant path (84, 85).

DESCRIPTION OF EMBODIMENTS

Embodiments of the present invention will be described in detail below with reference to the drawings. The following embodiments are merely preferred examples in nature, and are not intended to limit the scopes of the present invention, applications thereof, and use thereof.

Figure 1:
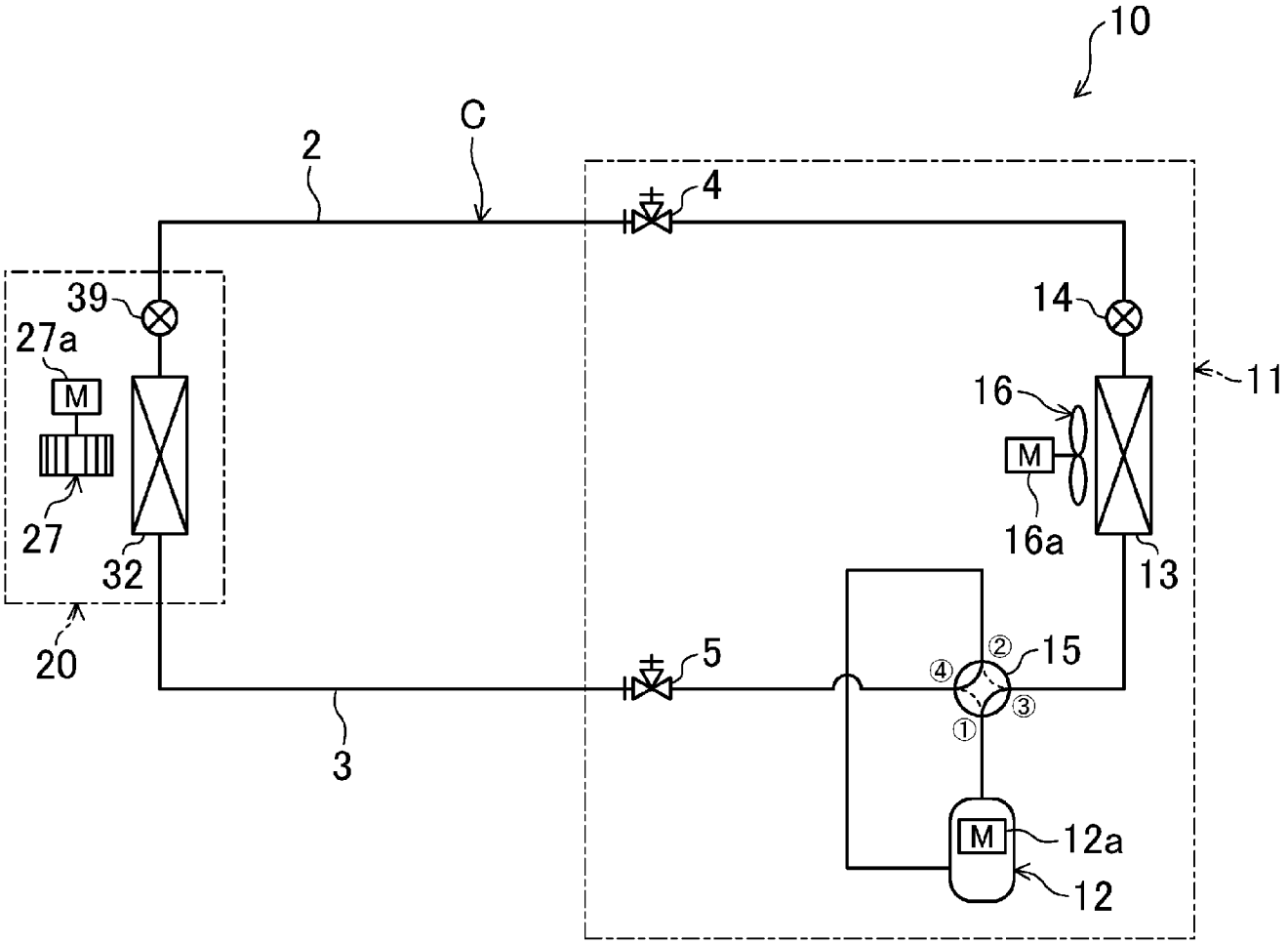
FIG. 1 is a piping diagram showing a general configuration of a refrigerant circuit for an air conditioning device according to an embodiment.

An embodiment of the present invention is an air conditioning device (10) performing cooling and heating operations in a room. As illustrated in FIG. 1, the air conditioning device (10) includes an outdoor unit (11) installed outdoors and an indoor unit (20) installed indoors. The outdoor unit (11) and the indoor unit (20) are connected with each other through two communication pipes (2, 3), which thus forms a refrigerant circuit (C) in this air conditioning device (10). In the refrigerant circuit (C), a refrigerant injected therein is circulated to perform a vapor compression refrigeration cycle.

<Configuration of Refrigerant Circuit>

The outdoor unit (11) is provided with a compressor (12), an outdoor heat exchanger (13), an outdoor expansion valve (14), and a four-way switching valve (15). The compressor (12) compresses a low-pressure refrigerant, and discharges a high-pressure refrigerant thus compressed. In the compressor (12), a compression mechanism such as a scroll or rotary compression mechanism is driven by a compressor motor (12*a*). The compressor motor (12*a*) is configured so that the number of rotation (i.e., the operation frequency) thereof can be changed by an inverter.

The outdoor heat exchanger (13) is a fin and tube heat exchanger. An outdoor fan (16) is installed near the outdoor heat exchanger (13). In the outdoor heat exchanger (13), the air carried by the outdoor fan (16) exchanges heat with a refrigerant. The outdoor fan (16) is configured as a propeller fan driven by an outdoor fan motor (16*a*). The outdoor fan motor (16*a*) is configured so that the number of rotation thereof can be changed by an inverter.

The outdoor expansion valve (14) is configured as an electronic expansion valve, of which the degree of opening is variable. The four-way switching valve (15) includes first to fourth ports. In the four-way switching valve (15), the first port is connected to a discharge side of the compressor (12), the second port is connected to a suction side of the compressor (12), the third port is connected to a gas-side end portion of the outdoor heat exchanger (13), and the fourth port is connected to a gas-side shut-off valve (5). The four-way switching valve (15) is switchable between a first state (a state shown by the solid lines in FIG. 1) and a second state (a state shown by the broken lines in FIG. 1). In the four-way switching valve (15) in the first state, the first port communicates with the third port, and the second port communicates with the fourth port. In the four-way switching valve (15) in the second state, the first port communicates with the fourth port, and the second port communicates with the third port.

The two communication pipes are embodied as a liquid communication pipe (2) and a gas communication pipe (3). One end of the liquid communication pipe (2) is connected to a liquid-side shut-off valve (4), and the other end thereof is connected to a liquid-side end portion of the indoor heat exchanger (32). One end of the gas communication pipe (3) is connected to a gas-side shut-off valve (5), and the other end thereof is connected to a gas-side end portion of the indoor heat exchanger (32).

The indoor unit (20) is provided with the indoor heat exchanger (32) and an indoor expansion valve (39). The indoor heat exchanger (32) is a fin and tube heat exchanger. An indoor fan (27) is installed near the indoor heat exchanger (32). The indoor fan (27) is a centrifugal blower driven by an indoor fan motor (27*a*). The indoor fan motor (27*a*) is configured so that the number of rotation thereof can be changed by an inverter. In the refrigerant circuit (C), the indoor expansion valve (39) is connected to the liquid-side end portion of the indoor heat exchanger (32). The indoor expansion valve (39) is configured as an electronic expansion valve, of which the degree of opening is variable.

<Detailed Structure of Indoor Unit>

A detailed structure of the indoor unit (20) of the air conditioning device (10) will be described with reference to FIGS. 2-4. The indoor unit (20) of this embodiment is configured as a ceiling mounted indoor unit. Specifically, as illustrated in FIG. 3, the indoor unit (20) is fitted and attached into an opening (O) of a ceiling (U) facing the room space (R). The indoor unit (20) includes an indoor unit body (21) and a decorative panel (40) attached to the bottom of the indoor unit body (21).

—Indoor Unit Body—

Figure 2:
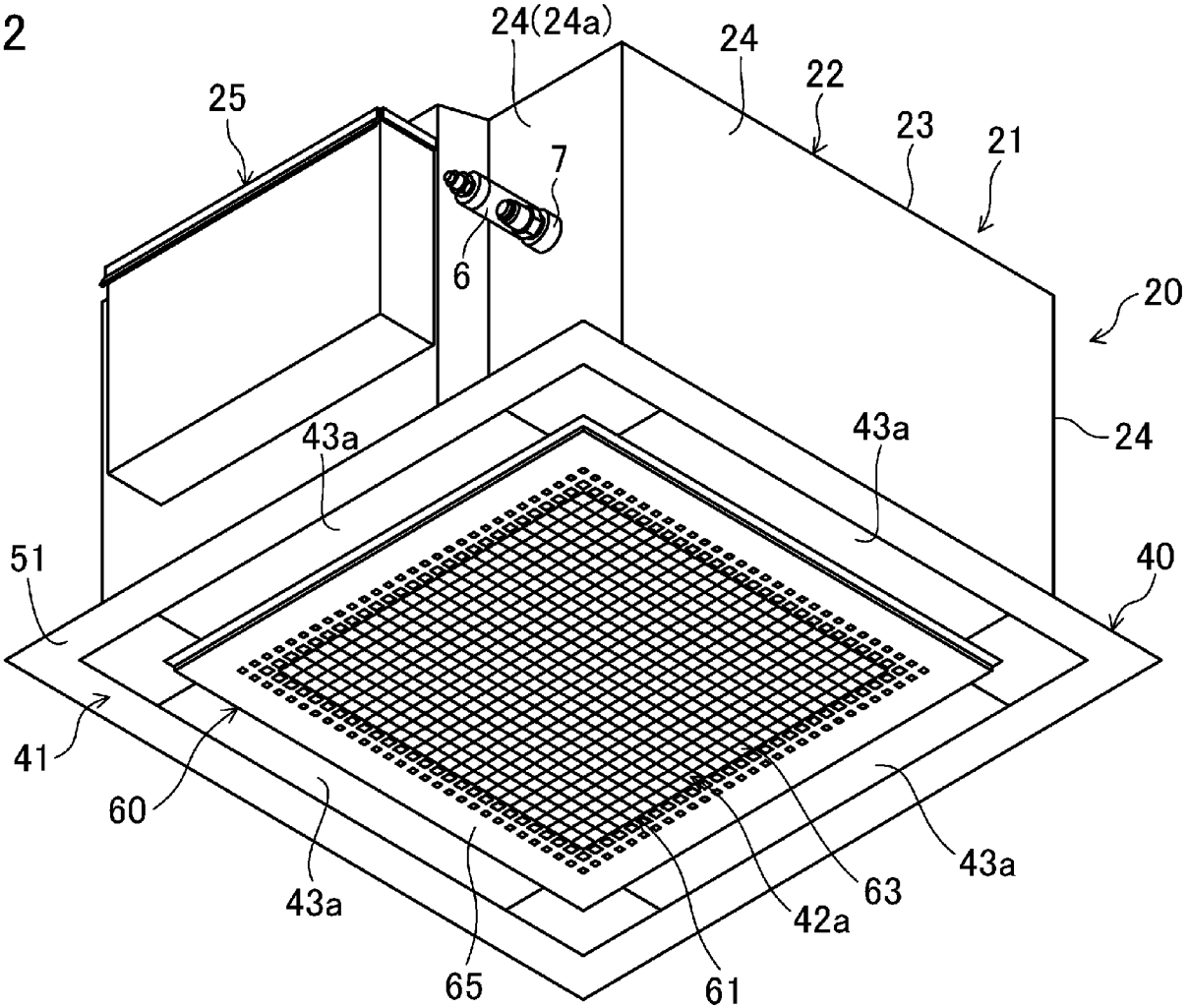
FIG. 2 is a perspective view showing the appearance of an indoor unit according to an embodiment.
Figure 3:
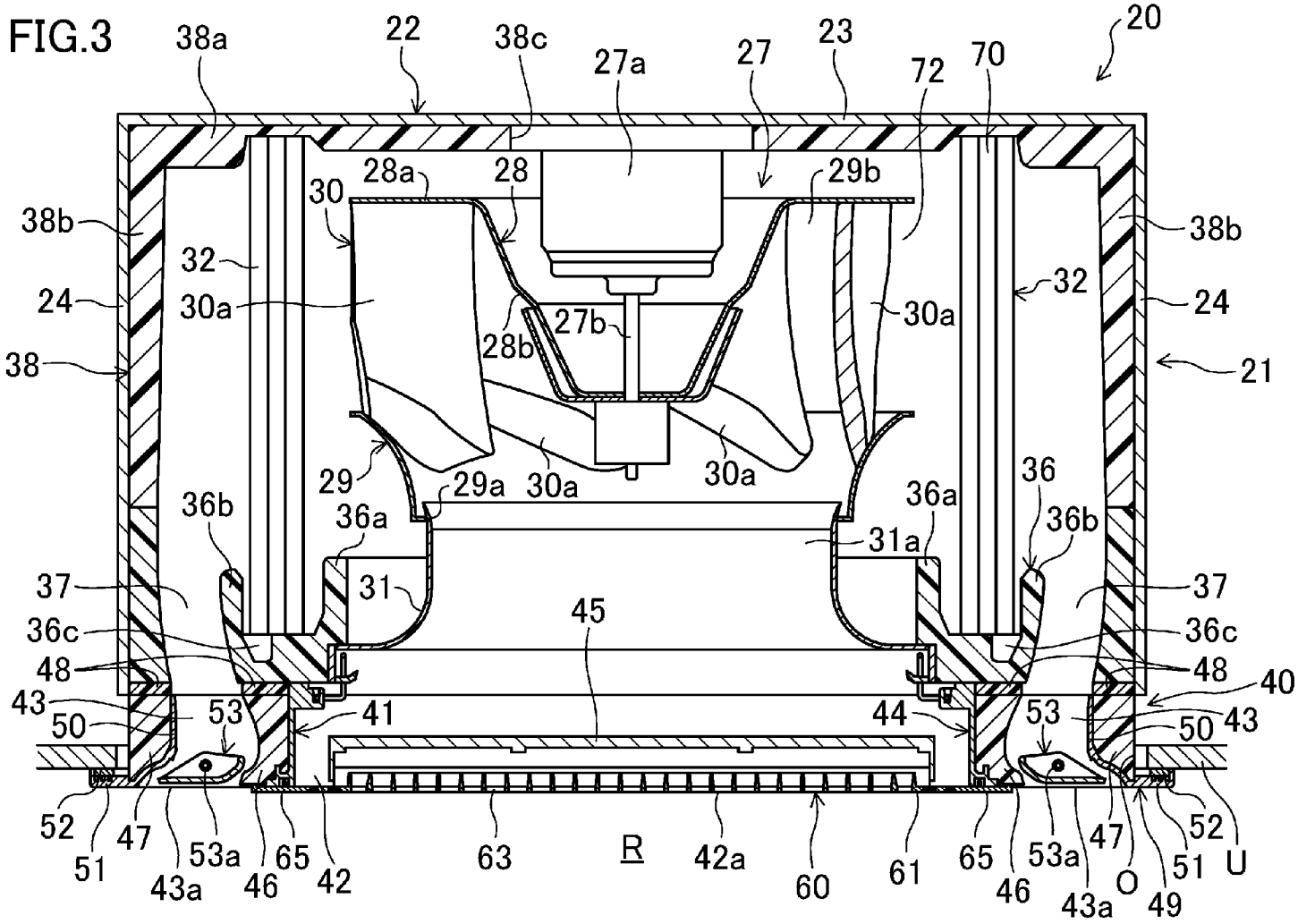
FIG. 3 is a vertical cross-sectional view showing the internal structure of an indoor unit according to an embodiment.

As illustrated in FIGS. 2 and 3, the indoor unit body (21) includes a box-shaped casing (22) having a generally rectangular parallelepiped shape. The casing (22) includes a top panel (23) which is generally square in a plan view and four generally rectangular side panels (24) extending downward from a peripheral portion of the top panel (23). The lower surface of the casing (22) has an opening. As illustrated in FIG. 2, an elongate, box-shaped electric component box (25) is attached to a side panel (24*a*), which is one of the four side panels (24). Also, a liquid-side connecting pipe (6) and a gas-side connecting pipe (7), which are connected to the indoor heat exchanger (32), run through this side panel (24*a*). The liquid-side connecting pipe (6) is connected with the liquid communication pipe (2), and the gas-side connecting pipe (7) is connected with the gas communication pipe (3).

The casing (22) houses the indoor fan (27), a bell mouth (31), the indoor heat exchanger (32), and a drain pan (36).

Figure 4:
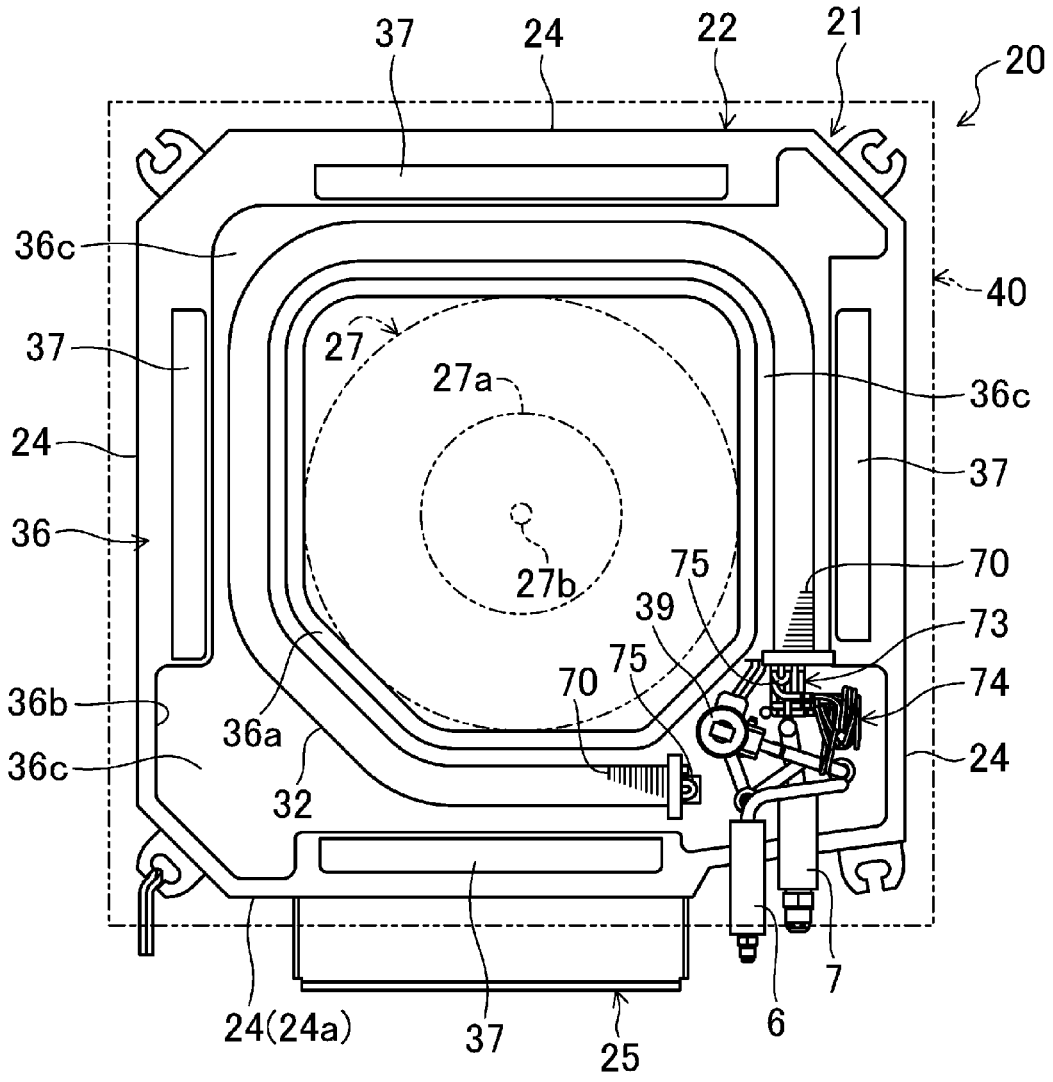
FIG. 4 is a plan view of the inside of an indoor unit according to an embodiment as viewed from over its top panel.

As illustrated in FIGS. 3 and 4, the indoor fan (27) is arranged at the center inside the casing (22). The indoor fan (27) includes the indoor fan motor (27*a*), a hub (28), a shroud (29), and an impeller (30). The indoor fan motor (27*a*) is supported on the top panel (23) of the casing (22). The hub (28) is fixed to a lower end of the indoor fan motor's (27*a*) drive shaft (27*b*) to be driven in rotation. The hub (28) includes a ringlike base (28*a*) provided radially outside of the indoor fan motor (27*a*), and a central swelling portion (28*b*) expanding downward from an inner peripheral portion of the base (28*a*).

The shroud (29) is arranged under the base (28*a*) of the hub (28) so as to face the base (28*a*). A lower portion of the shroud (29) is provided with a circular central suction port (29*a*) communicating with the inside of the bell mouth (31). The impeller (30) is housed in an impeller housing space (29*b*) between the hub (28) and the shroud (29). The impeller (30) is comprised of a plurality of turbo blades (30*a*) arranged along the rotation direction of the drive shaft (27*b*).

The bell mouth (31) is arranged under the indoor fan (27). The bell mouth (31) has a circular opening at each of its upper and lower ends, and is formed in a tubular shape so that the area of the opening increases toward the decorative panel (40). The inner space (31*a*) of the bell mouth (31) communicates with the impeller housing space (29*b*) of the indoor fan (27).

As illustrated in FIG. 4, the indoor heat exchanger (32) is provided so as to surround the indoor fan (27) by bending a refrigerant pipe (a heat transfer tube). The indoor heat exchanger (32) is installed on the upper surface of the drain pan (36) so as to stand up vertically. Air blowing laterally from the indoor fan (27) passes through the indoor heat exchanger (32). The indoor heat exchanger (32) serves as an evaporator that cools the air during a cooling operation, and also serves as a condenser (a radiator) that heats the air during a heating operation.

As illustrated in FIGS. 3 and 4, the drain pan (36) is arranged under the indoor heat exchanger (32). The drain pan (36) includes an inner wall portion (36*a*), an outer wall portion (36*b*), and a water receiving portion (36*c*). The inner wall portion (36*a*) is formed along an inner peripheral portion of the indoor heat exchanger (32), and is configured as a ringlike vertical wall that stands up vertically. The outer wall portion (36*b*) is formed along the four side panels (24) of the casing (22), and is also configured as a ringlike vertical wall that stands up vertically. The water receiving portion (36*c*) is provided between the inner wall portion (36*a*) and the outer wall portion (36*b*), and is configured as a groove for collecting condensed water produced by the indoor heat exchanger (32). In addition, four body-side blowout flow channels (37) extending along the four associated side panels (24) are provided to vertically run through the outer wall portion (36*b*) of the drain pan (36). Each of the body-side blowout flow channels (37) allows a downstream space of the indoor heat exchanger (32) to communicate with an associated one of four panel-side blowout flow channels (43) of the decorative panel (40).

Also, a body-side heat insulator (38) is further provided for the indoor unit body (21). The body-side heat insulator (38) is generally in the shape of a box with an opened bottom. The body-side heat insulator (38) includes a top panel-side heat insulating portion (38*a*) formed along the top panel (23) of the casing (22) and a side panel-side heat insulating portion (38*b*) formed along the side panels (24) of the casing (22). A central portion of the top panel-side heat insulating portion (38*a*) has a circular through hole (38*c*) that an upper end portion of the indoor fan motor (27*a*) penetrates. The side panel-side heat insulating portion (38*b*) is arranged outside the body-side blowout flow channels (37) in the outer wall portion (36*b*) of the drain pan (36).

—Decorative Panel—

The decorative panel (40) is attached to the lower surface of the casing (22). The decorative panel (40) includes a panel body (41) and a suction grill (60).

The panel body (41) has a rectangular frame shape in a plan view. The panel body (41) has one panel-side suction flow channel (42) and four panel-side blowout flow channels (43).

As illustrated in FIG. 3, the panel-side suction flow channel (42) is formed in a central portion of the panel body (41). A suction port (42*a*) facing the room space (R) is provided at the lower end of the panel-side suction flow channel (42). The panel-side suction flow channel (42) allows the suction port (42*a*) to communicate with the inner space (31*a*) of the bell mouth (31). An inside panel member (44) having a frame shape is fitted into the panel-side suction flow channel (42). Also, in the panel-side suction flow channel (42), provided is a dust collection filter (45) that catches dust in the air sucked through the suction port (42*a*).

The respective panel-side blowout flow channels (43) are arranged outside the panel-side suction flow channel (42) so as to surround the panel-side suction flow channel (42). Each of the panel-side blowout flow channels (43) extends along an associated one of four sides of the panel-side suction flow channel (42). An outlet port (43*a*) facing the room space (R) is provided at the lower end of each of the panel-side blowout flow channels (43). Each of the panel-side blowout flow channels (43) allows an associated one of the outlet ports (43*a*) to communicate with an associated one of the body-side blowout flow channels (37).

As illustrated in FIG. 3, an inside heat insulating portion (46) is provided inside of the panel-side blowout flow channels (43) (i.e., is provided closer to the center of the panel body (41)). Also, an outside heat insulating portion (47) is provided outside of the panel-side blowout flow channels (43) (i.e., is provided closer to the outer periphery of the panel body (41)). An inside seal member (48) is provided on the upper surface of the inside heat insulating portion (46) and the outside heat insulating portion (47) so as to be interposed between the panel body (41) and the drain pan (36).

An outside panel member (49) is fitted into an inner edge portion of the outside heat insulating portion (47). The outside panel member (49) includes an inner wall portion (50) serving as an inner wall surface of the body-side blowout flow channel (37) and an extended portion (51) extended from a lower end portion of the inner wall portion (50) toward an outer edge portion of the panel body (41). The extended portion (51) is formed in the shape of a rectangular frame along the lower surface of the ceiling (U). An outside seal member (52) is provided on the upper surface of the extended portion (51) so as to be interposed between the extended portion (51) and the ceiling (U).

Also, each of the body-side blowout flow channels (37) is provided with an airflow direction adjusting blade (53) for adjusting the flow direction of the air (blown out air) flowing through the body-side blowout flow channels (37). The airflow direction adjusting blades (53) are provided over both ends of the body-side blowout flow channels (37) in the longitudinal direction thereof so as to be arranged along the side panels (24) of the casing (22). The airflow direction adjusting blades (53) are each configured to be rotatable on a rotation shaft (53*a*) extending in the longitudinal direction thereof.

The suction grill (60) is attached to the lower end of the panel-side suction flow channel (42) (i.e., the suction port (42*a*)). The suction grill (60) includes a grill body (61) facing the suction port (42*a*), and a rectangular extended portion (65) extended outward from the grill body (61) toward the respective outlet ports (43*a*). The grill body (61) is generally square in a plan view. In the grill body (61), many suction holes (63) are arranged in a grid pattern. These suction holes (63) are configured as through holes that run through the grill body (61) in the thickness direction (or vertical direction) thereof. Each suction hole (63) is an opening with a square cross section.

The extended portion (65) of the suction grill (60) has a rectangular frame shape so as to extend outward from the grill body (61) toward the outlet ports (43*a*). The extended portion (65) overlaps with the panel body (41) vertically so as to be in contact with the lower surface of the inside heat insulating portion (46). Also, a lateral end portion of the extended portion (65) is shifted closer to the suction port (42*a*) than an inside edge portion of the outlet ports (43*a*).

—Operation—

Next, it will be described how the air conditioning device (10) of this embodiment operates. This air conditioning device (10) performs a cooling operation and a heating operation selectively.

<Cooling Operation>

During a cooling operation, the four-way switching valve (15) is turned to the state indicated by the solid lines in FIG. 1 to make the compressor (12), the indoor fan (27), and the outdoor fan (16) operate. Thus, the refrigerant circuit (C) performs a refrigeration cycle in which the outdoor heat exchanger (13) serves as a condenser and the indoor heat exchanger (32) serves as an evaporator.

Specifically, a high-pressure refrigerant compressed by the compressor (12) flows through the outdoor heat exchanger (13) and exchanges heat with outdoor air. In the outdoor heat exchanger (13), the high-pressure refrigerant dissipates heat to the outdoor air and is condensed. The refrigerant condensed in the outdoor heat exchanger (13) is passed to the indoor unit (20). In the indoor unit (20), the refrigerant has its pressure reduced by the indoor expansion valve (39), and subsequently flows through the indoor heat exchanger (32).

In the indoor unit (20), indoor air flows upward through the suction port (42*a*), the panel-side suction flow channel (42), and the inner space (31*a*) of the bell mouth (31) in this order, and then is sucked into the impeller housing space (29*b*) of the indoor fan (27). The air in the impeller housing space (29*b*) is carried by the impeller (30) and is blown out radially outward from between the hub (28) and the shroud (29). This air passes through the indoor heat exchanger (32) and exchanges heat with a refrigerant. In the indoor heat exchanger (32), the refrigerant absorbs heat from the indoor air, and evaporates. Consequently, the air is cooled by the refrigerant.

The air cooled by the indoor heat exchanger (32) is divided into the body-side blowout flow channels (37), then flows downward through the panel-side blowout flow channels (43), and is subsequently supplied though the outlet port (43*a*) into the room space (R). Also, the refrigerant evaporated in the indoor heat exchanger (32) is sucked into the compressor (12), and is compressed there again.

<Heating Operation>

During a heating operation, the four-way switching valve (15) is turned to the state indicated by the broken lines in FIG. 1 to make the compressor (12), the indoor fan (27), and the outdoor fan (16) operate. Thus, this refrigerant circuit (C) performs a refrigeration cycle in which the indoor heat exchanger (32) serves as a condenser and the outdoor heat exchanger (13) serves as an evaporator.

Specifically, a high-pressure refrigerant compressed by the compressor (12) flows through the indoor heat exchanger (32) of the indoor unit (20). In the indoor unit (20), indoor air flows upward through the suction port (42*a*), the panel-side suction flow channel (42), and the inner space (31*a*) of the bell mouth (31) in this order, and then is sucked into the impeller housing space (29*b*) of the indoor fan (27). The air in the impeller housing space (29*b*) is carried by the impeller (30) and is blown out radially outward from between the hub (28) and the shroud (29). This air passes through the indoor heat exchanger (32) and exchanges heat with a refrigerant. In the indoor heat exchanger (32), the refrigerant dissipates heat to indoor air, and is condensed. Consequently, the air is heated by the refrigerant.

The air heated by the indoor heat exchanger (32) is divided into the body-side blowout flow channels (37), then flows downward through the panel-side blowout flow channels (43), and is subsequently supplied through the outlet ports (43*a*) into the room space (R). Also, the refrigerant condensed in the indoor heat exchanger (32) has its pressure reduced by the outdoor expansion valve (14), and subsequently flows through the outdoor heat exchanger (13). In the outdoor heat exchanger (13), the refrigerant absorbs heat from outdoor air, and evaporates. The refrigerant evaporated from the outdoor heat exchanger (13) is sucked into the compressor (12), and is compressed there again.

<Indoor Heat Exchanger and Its Surrounding Structure>

Next, the indoor heat exchanger (32) of this embodiment and surrounding structure thereof will be described in detail with reference to FIGS. 3-11.

The indoor heat exchanger (32) of this embodiment is arranged on the upper surface of the drain pan (36) so as to surround the indoor fan (27). The indoor heat exchanger (32) includes a plurality of fins (70) and a plurality of heat transfer tubes (71) running through the plurality of fins (70). The plurality of fins (70) are provided in an elongate plate shape and extended vertically so as to cross at right angles with the air carried to the indoor fan (27). Each of the heat transfer tubes (71) is bent so as to surround the indoor fan (27), and provided along the side panels (24) of the casing (22). The fins (70) are arranged at regular intervals in the longitudinal direction of the heat transfer tubes (71) (see FIG. 4).

Figure 5:
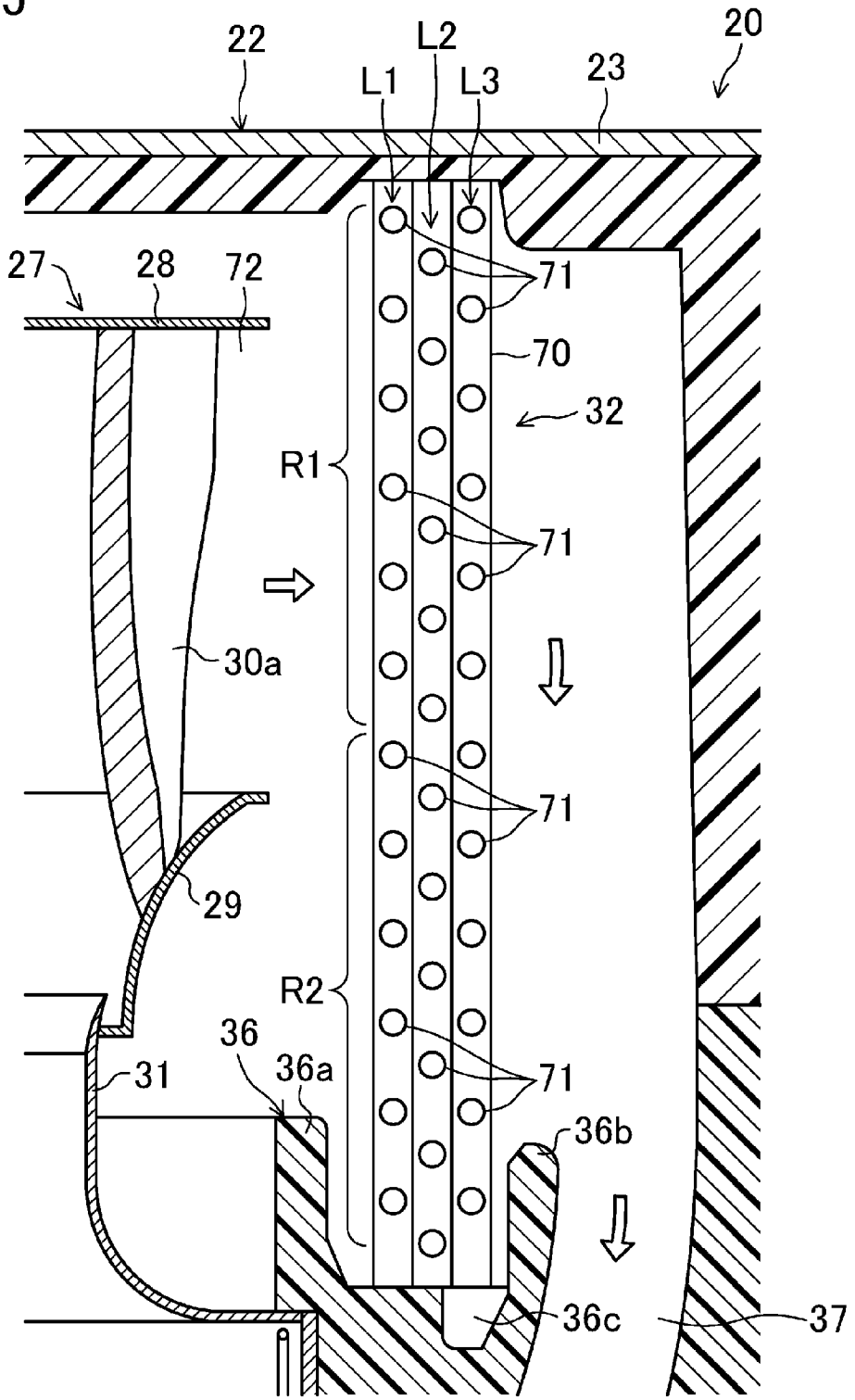
FIG. 5 is an enlarged vertical cross-sectional view of an indoor heat exchanger and a surrounding structure thereof according to an embodiment.

The indoor heat exchanger (32) includes a plurality of (e.g., three in this embodiment) tube lines (L1, L2, L3) that are arranged so as to intersect with an airflow direction (i.e., the rightward direction in FIG. 5). In other words, these tube lines (L1, L2, L3) are arranged in the width direction of the fins (70). The three tube lines (L1, L2, L3) are comprised of a windward tube line (L1) located most upstream (i.e., located nearest to the indoor fan (27)) in the airflow direction, a leeward tube line (L3) located most downstream (i.e., located farthest away from the indoor fan (27)) in the airflow direction, and an intermediate tube line (L2) located between the windward tube line (L1) and the leeward tube line (L3). In each of the tube lines (L1, L2, L3), a plurality of (e.g., twelve in this embodiment) heat transfer tubes (71) are arranged vertically.

Figure 6:
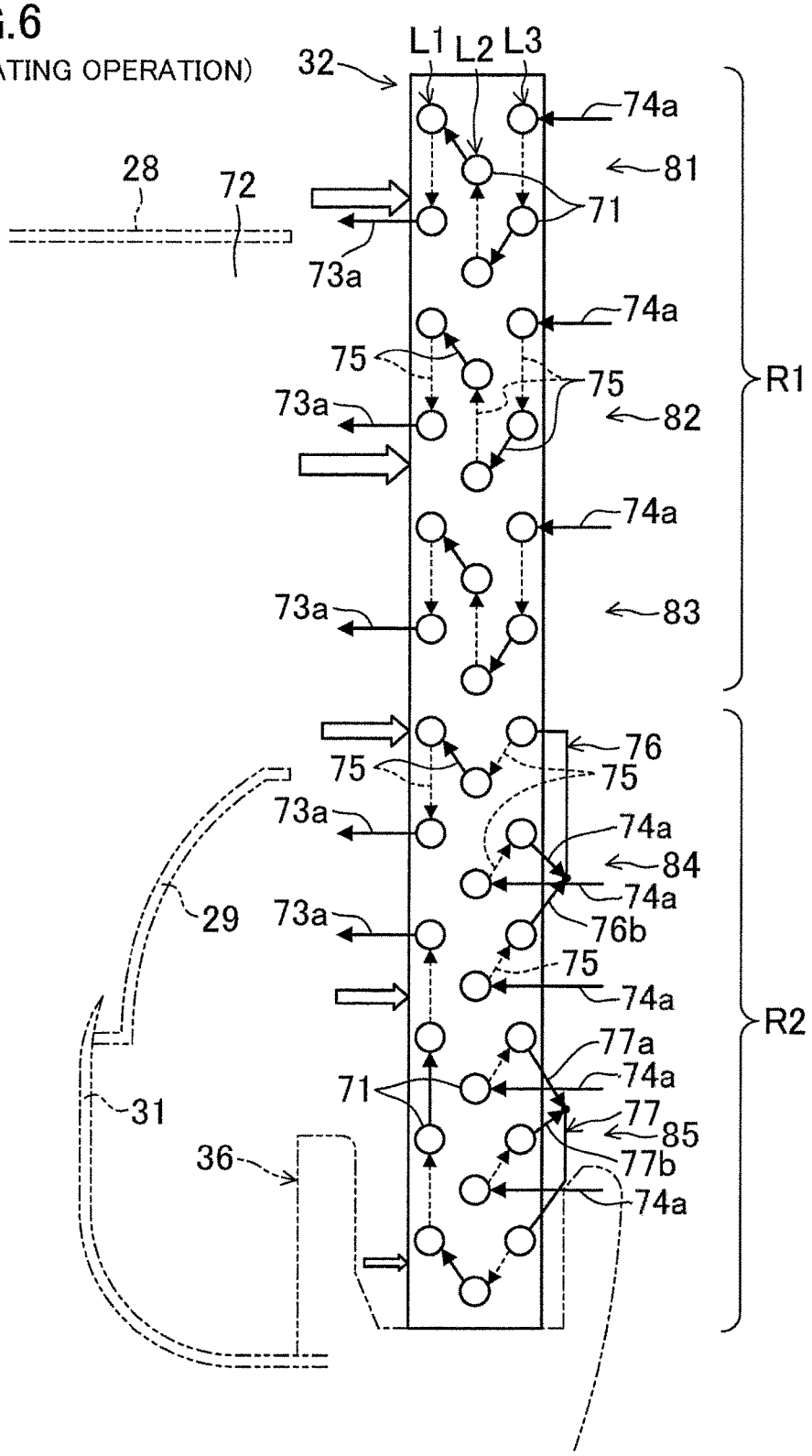
FIG. 6 illustrates a schematic arrangement of refrigerant paths in an indoor heat exchanger during a heating operation according to an embodiment.
Figure 7:
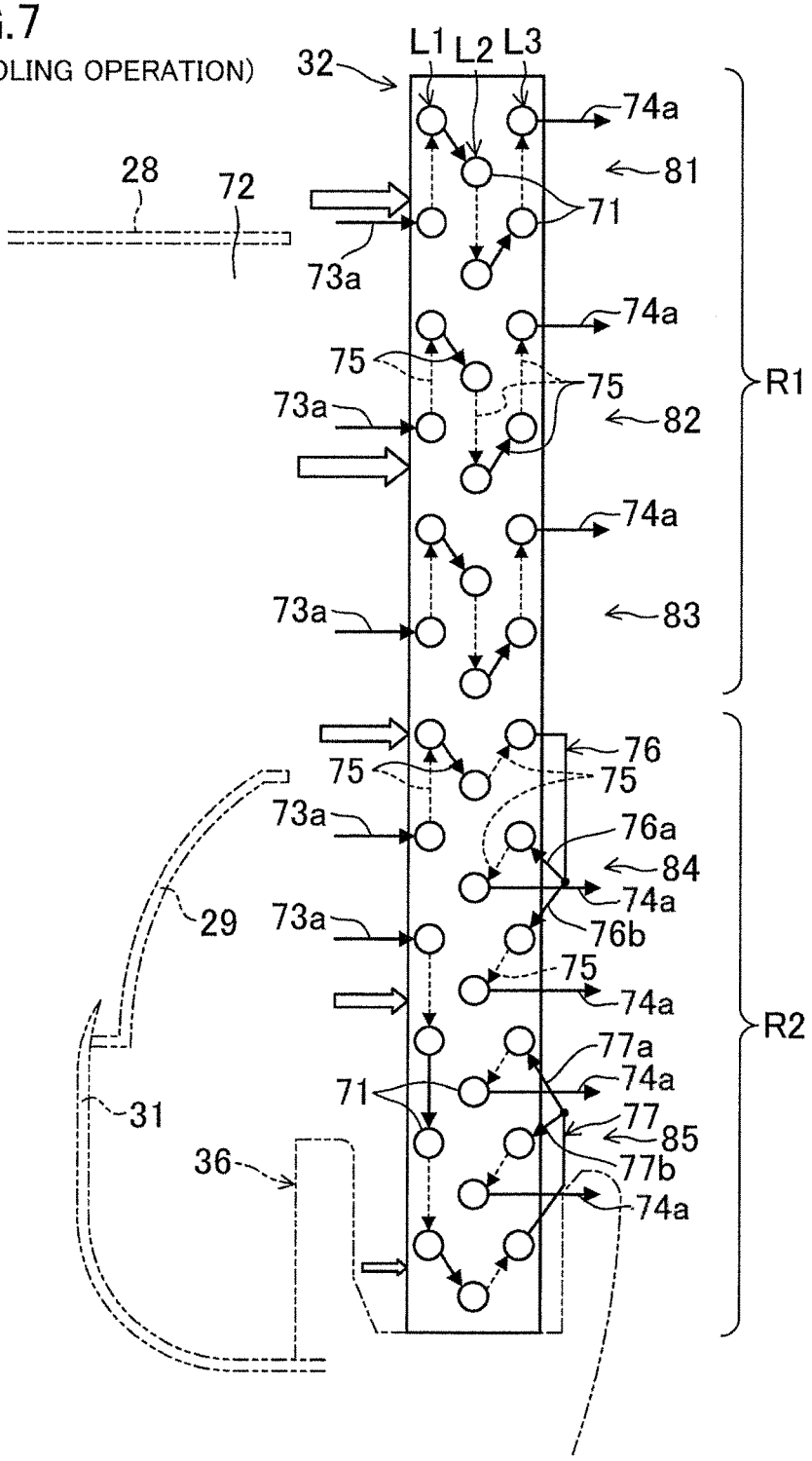
FIG. 7 illustrates a schematic arrangement of refrigerant paths in an indoor heat exchanger during a cooling operation according to an embodiment.

As illustrated in FIGS. 5-7, a first region (R1) forms a generally upper half of the indoor heat exchanger (32), and a second region (R2) forms a generally lower half thereof. Most of the first region (R1) faces a blowout passage (72) of the indoor fan (27) (i.e., a passage formed between the hub (28) and the shroud (29)). Consequently, in the indoor heat exchanger (32), the air passing through the first region (R1) comes to have a relatively high flow velocity. In contrast, most of the second region (R2) does not face the blowout passage (72) of the indoor fan (27). More particularly, an upper portion of the second region (R2) faces outer peripheral surfaces of the shroud (29) and the bell mouth (31), and a lower portion of the second region (R2) is located inside the drain pan (36). Consequently, in the indoor heat exchanger (32), the flow velocity of the air passing through the second region (R2) is lower than that of the air passing through the first region (R1).

Figure 8:
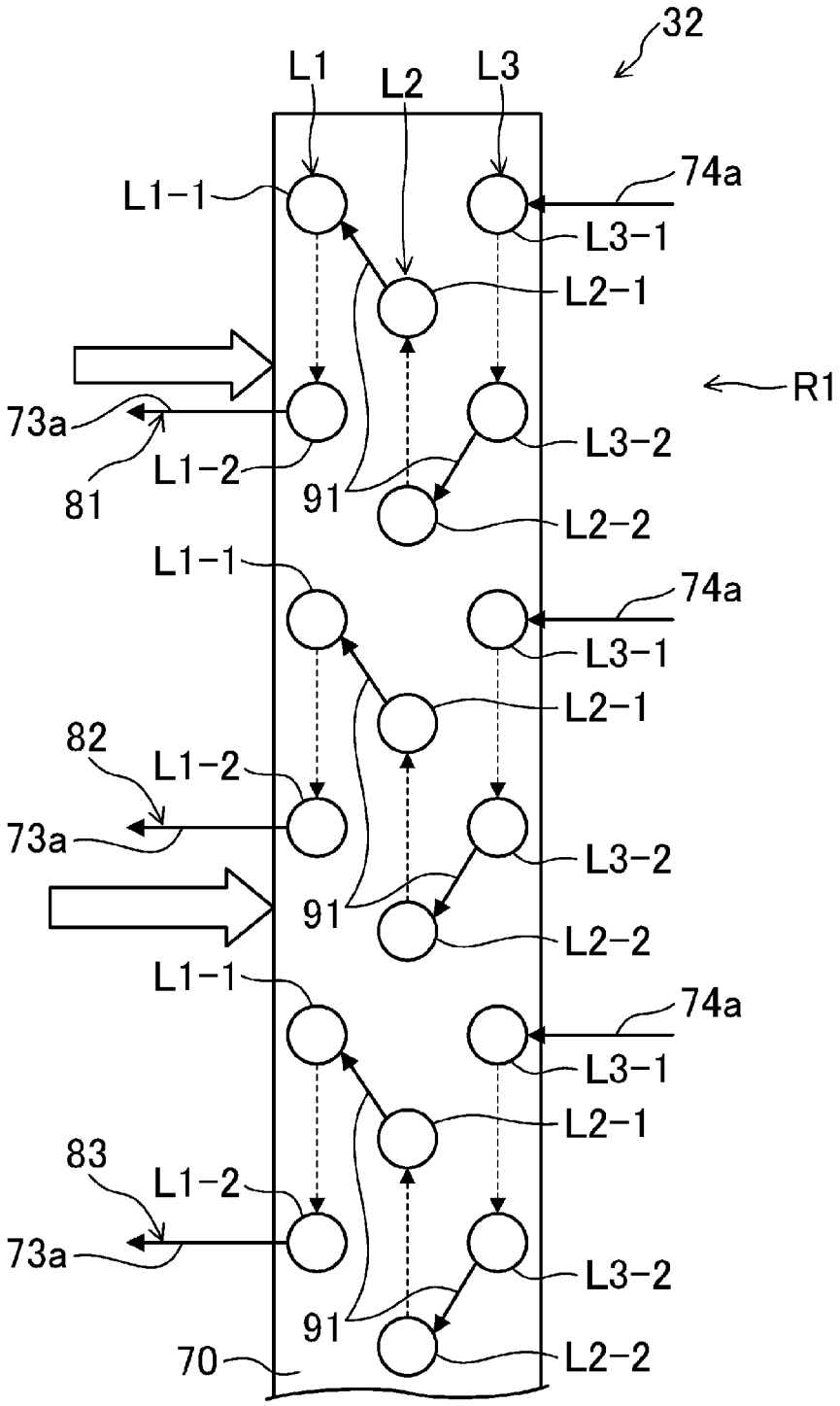
FIG. 8 is a partially enlarged view showing refrigerant paths in a first region of an indoor heat exchanger during a heating operation according to an embodiment.

As illustrated in FIGS. 6-8, in the first region (R1) of the indoor heat exchanger (32), a plurality of (e.g., three in this embodiment) series paths (81, 82, 83) are arranged vertically. Specifically, in the first region (R1), an upper series path (81) is formed as the uppermost path, a lower series path (83) is formed as the lowermost one, and an intermediate series path (82) is formed between the upper series path (81) and the lower series path (83). These series paths (81, 82, 83) constitute first refrigerant paths defined in the first region (R1).

Each of these series paths (81, 82, 83) is connected to a gas-side header (73) and a liquid flow divider (74) (see FIG. 4). The gas-side header (73) is connected to the gas communication pipe (3) of the refrigerant circuit (C) through the gas-side connecting pipe (7). The liquid flow divider (74) is connected to the liquid communication pipe (2) of the refrigerant circuit (C) through the liquid-side connecting pipe (6). In each of these series paths (81, 82, 83), six heat transfer tubes (71) are connected between a branch pipe (73*a*) of the gas-side header (73) and a flow dividing channel (74*a*) of the liquid flow divider (74).

Specifically, in the windward tube line (L1) of each of the series paths (81, 82, 83), a first windward heat transfer tube (L1-1) is formed closer to the top of the path (81, 82, 83), and a second windward heat transfer tube (L1-2) is formed closer to the bottom thereof. Also, in the intermediate tube line (L2) of each of the series paths (81, 82, 83), a first intermediate heat transfer tube (L2-1) is formed closer to the top of the path (81, 82, 83), and a second intermediate heat transfer tube (L2-2) is formed closer to the bottom thereof. Furthermore, in the leeward tube line (L3) of each of the series paths (81, 82, 83), a first leeward heat transfer tube (L3-1) is formed closer to the top of the path (81, 82, 83), and a second leeward heat transfer tube (L3-2) is formed closer to the bottom thereof.

In each of the series paths (81, 82, 83), the second windward heat transfer tube (L1-2), the first windward heat transfer tube (L1-1), the first intermediate heat transfer tube (L2-1), the second intermediate heat transfer tube (L2-2), the second leeward heat transfer tube (L3-2), and the first leeward heat transfer tube (L3-1) are connected in this order from the branch pipe (73*a*) of the gas-side header (73) toward the flow dividing channel (74*a*) of the liquid flow divider (74). These heat transfer tubes (71) are connected together through U-shaped portions (75) bent in a U shape.

Figure 9:
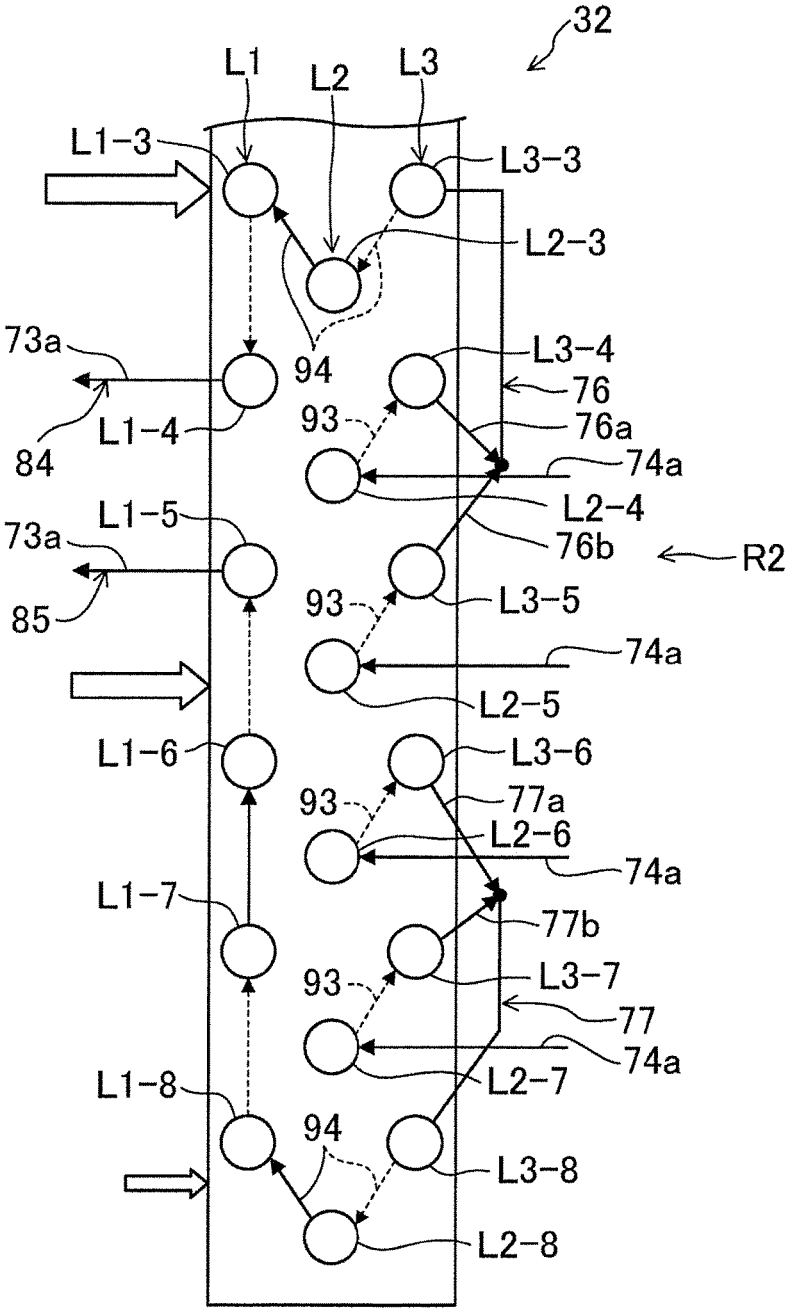
FIG. 9 is a partially enlarged view showing refrigerant paths in a second region of the indoor heat exchanger during a heating operation according to an embodiment.

As illustrated in FIGS. 6, 7, and 9, in the second region (R2) of the indoor heat exchanger (32), two parallel paths (84, 85) are arranged in the vertical direction. Specifically, an upper parallel path (84) forms an upper part of the second region (R2), and a lower parallel path (85) forms a lower part of the second region (R2). These parallel paths (84, 85) constitute second refrigerant paths formed in the second region (R2).

Each of the parallel paths (84, 85) is connected to the gas-side header (73) and the liquid flow divider (74). In the upper parallel path (84), eight heat transfer tubes (71) are connected between the branch pipe (73*a*) of the gas-side header (73) and the flow dividing channel (74*a*) of the liquid flow divider (74). That is, the number of the heat transfer tubes (71) in the upper parallel path (84) is larger than that of the heat transfer tubes (71) in the series paths (81, 82, 83).

As illustrated in FIG. 9, in the windward tube line (L1) of the upper parallel path (84), a third windward heat transfer tube (L1-3) is formed closer to the top of the path (84), and a fourth windward heat transfer tube (L1-4) is formed closer to the bottom thereof. Also, in the intermediate tube line (L2) of the upper parallel path (84), a third intermediate heat transfer tube (L2-3), a fourth intermediate heat transfer tube (L2-4), and a fifth intermediate heat transfer tube (L2-5) are arranged in this order from top to bottom. Furthermore, in the leeward tube line (L3) of the upper parallel path (84), a third leeward heat transfer tube (L3-3), a fourth leeward heat transfer tube (L3-4), and a fifth leeward heat transfer tube (L3-5) are arranged in this order from top to bottom.

In the upper parallel path (84), the fourth windward heat transfer tube (L1-4), the third windward heat transfer tube (L1-3), the third intermediate heat transfer tube (L2-3), and the third leeward heat transfer tube (L3-3) are connected in this order from the branch pipe (73*a*) of the gas-side header (73) toward the flow dividing channel (74*a*) of the liquid flow divider (74). The fourth windward heat transfer tube (L1-4), the third windward heat transfer tube (L1-3), the third intermediate heat transfer tube (L2-3), and the third leeward heat transfer tube (L3-3) are connected together through the U-shaped portions (75).

One end (a liquid-side end portion) of the third leeward heat transfer tube (L3-3) is connected with one end of a first flow dividing pipe (76) that serves as a flow dividing portion. The other end of the first flow dividing pipe (76) branches into two connecting pipes (76*a*, 76*b*). In the first flow dividing pipe (76), the one connecting pipe (76*a*) is connected to one end (a gas-side end portion) of the fourth leeward heat transfer tube (L3-4), and the other connecting pipe (76*b*) is connected to one end (a gas-side end portion) of the fifth leeward heat transfer tube (L3-5). The other end of the fourth leeward heat transfer tube (L3-4) is connected to the flow dividing channel (74*a*) of the liquid flow divider (74) through the fourth intermediate heat transfer tube (L2-4). Also, the other end of the fifth leeward heat transfer tube (L3-5) is connected to the flow dividing channel (74*a*) of the liquid flow divider (74) through the fifth intermediate heat transfer tube (L2-5).

In the lower parallel path (85), ten heat transfer tubes (71) are connected between the branch pipe (73*a*) of the gas-side header (73) and the flow dividing channel (74*a*) of the liquid flow divider (74). That is, the number of the heat transfer tubes (71) in the lower parallel path (85) is larger than that of the heat transfer tubes (71) in the series paths (81, 82, 83) or that of the heat transfer tubes (71) in the upper parallel path (84).

As illustrated in FIG. 9, in the windward tube line (L1) of the lower parallel path (85), a fifth windward heat transfer tube (L1-5), a sixth windward heat transfer tube (L1-6), a seventh windward heat transfer tube (L1-7), and an eighth windward heat transfer tube (L1-8) are arranged in this order from top to bottom. In the intermediate tube line (L2) of the lower parallel path (85), a sixth intermediate heat transfer tube (L2-6), a seventh intermediate heat transfer tube (L2-7), and an eighth intermediate heat transfer tube (L2-8) are arranged in this order from top to bottom. In the leeward tube line (L3) of the lower parallel path (85), a sixth leeward heat transfer tube (L3-6), a seventh leeward heat transfer tube (L3-7), and an eighth leeward heat transfer tube (L3-8) are arranged in this order from top to bottom.

In the lower parallel path (85), the fifth windward heat transfer tube (L1-5), the sixth windward heat transfer tube (L1-6), the seventh windward heat transfer tube (L1-7), the eighth windward heat transfer tube (L1-8), the eighth intermediate heat transfer tube (L2-8), and the eighth leeward heat transfer tube (L3-8) are connected in this order from the branch pipe (73*a*) of the gas-side header (73) toward the flow dividing channel (74*a*) of the liquid flow divider (74). The fifth windward heat transfer tube (L1-5), the sixth windward heat transfer tube (L1-6), the seventh windward heat transfer tube (L1-7), the eighth windward heat transfer tube (L1-8), the eighth intermediate heat transfer tube (L2-8), and the eighth leeward heat transfer tube (L3-8) are connected together through the U-shaped portions (75). Also, one end (a liquid-side end portion) of the eighth leeward heat transfer tube (L3-8) is connected with one end of a second flow dividing pipe (77) that serves as a flow dividing portion. The other end of the second flow dividing pipe (77) branches into two connecting pipes (77*a*, 77*b*). In the second flow dividing pipe (77), the one connecting pipe (77*a*) is connected to one end (a gas-side end portion) of the sixth leeward heat transfer tube (L3-6), and the other connecting pipe (77*b*) is connected to one end (a gas-side end portion) of the seventh leeward heat transfer tube (L3-7). The other end of the sixth leeward heat transfer tube (L3-6) is connected to the flow dividing channel (74*a*) of the liquid flow divider (74) through the sixth intermediate heat transfer tube (L2-6). Also, the other end of the seventh leeward heat transfer tube (L3-7) is connected to the flow dividing channel (74*a*) of the liquid flow divider (74) through the seventh intermediate heat transfer tube (L2-7).

<Refrigerant Paths during Heating Operation>

In the above-described indoor heat exchanger (32) during a heating operation, in each of the series paths (81, 82, 83) in the first region (R1), a counter flow portion (full counter flow portion (91)) is formed across the three tube lines (L1, L2, L3). Also, in the indoor heat exchanger (32) during the heating operation, in each of the parallel paths (84, 85) in the second region (R2), both a parallel flow portion (93) and a counter flow portion (94) are formed.

Specifically, as illustrated in FIG. 8, in the first region (R1) of the indoor heat exchanger (32) during a heating operation, a liquid refrigerant that has flowed out of the flow dividing channel (74*a*) of the liquid flow divider (74) flows into each of the series paths (81, 82, 83). The refrigerant that has flowed into each of the series paths (81, 82, 83) flows through the first leeward heat transfer tube (L3-1), the second leeward heat transfer tube (L3-2), the second intermediate heat transfer tube (L2-2), the first intermediate heat transfer tube (L2-1), the first windward heat transfer tube (L1-1), and the second windward heat transfer tube (L1-2) in this order, and then flows out into the branch pipe (73*a*) of the gas-side header (73).

In this manner, in each series path (81, 82, 83) during a heating operation, a refrigerant flows through the heat transfer tubes (71) of the leeward tube line (L3), the heat transfer tubes (71) of the intermediate tube line (L2), and the heat transfer tubes (71) of the windward tube line (L1) in this order. Thus, in the series path (81, 82, 83) during the heating operation, a counter flow portion (a full counter flow portion (91)) is formed over the entire region from the windward end portion through the leeward end portion. As a result, in the first region (R1), some temperature difference is ensured between the refrigerant and the air from the windward tube line (L1) through the leeward tube line (L3), and thus the heat exchanger effectiveness increases in the first region (R1).

Also, as illustrated in FIG. 9, in the second region (R2) of the indoor heat exchanger (32) during a heating operation, a liquid refrigerant that has flowed out of the flow dividing channel (74*a*) of the liquid flow divider (74) flows into each of the upper parallel path (84) and the lower parallel path (85).

In the upper parallel path (84), a refrigerant that has flowed through the flow dividing channel (74*a*) of the liquid flow divider (74) flows into the fourth intermediate heat transfer tube (L2-4) and the fifth intermediate heat transfer tube (L2-5). The refrigerant that has flowed into the fourth intermediate heat transfer tube (L2-4) flows through the fourth leeward heat transfer tube (L3-4) and then flows out to the first flow dividing pipe (76). The refrigerant that has flowed into the fifth intermediate heat transfer tube (L2-5) flows through the fifth leeward heat transfer tube (L3-5) and then flows out to the first flow dividing pipe (76). The refrigerant joined in the first flow dividing pipe (76) flows through the third leeward heat transfer tube (L3-3), the third intermediate heat transfer tube (L2-3), the third windward heat transfer tube (L1-3), and the fourth windward heat transfer tube (L1-4) in this order, and then flows out to the branch pipe (73*a*) of the gas-side header (73). In this manner, in the upper parallel path (84) during a heating operation, the refrigerant flows through the third leeward heat transfer tube (L3-3), the third intermediate heat transfer tube (L2-3), and the third windward heat transfer tube (L1-3) in this order so that counter flow portions (94) are formed just locally in the upper parallel path (84). Also, in the upper parallel path (84) during a heating operation, the refrigerant flows from the fourth intermediate heat transfer tube (L2-4) to the fourth leeward heat transfer tube (L3-4), and the refrigerant also flows from the fifth intermediate heat transfer tube (L2-5) to the fifth leeward heat transfer tube (L3-5) so that parallel flow portions (93) are formed just locally in the upper parallel path (84).

In the lower parallel path (85), the refrigerant that has flowed through the flow dividing channel (74*a*) of the liquid flow divider (74) flows into the sixth intermediate heat transfer tube (L2-6) and the seventh intermediate heat transfer tube (L2-7). The refrigerant that has flowed into the sixth intermediate heat transfer tube (L2-6) flows through the sixth leeward heat transfer tube (L3-6), and then flows out to the second flow dividing pipe (77). The refrigerant that has flowed into the seventh intermediate heat transfer tube (L2-7) flows through the seventh leeward heat transfer tube (L3-7) and then flows out to the second flow dividing pipe (77). The refrigerant joined in the second flow dividing pipe (77) flows through the eighth leeward heat transfer tube (L3-8), the eighth intermediate heat transfer tube (L2-8), the eighth windward heat transfer tube (L1-8), the seventh windward heat transfer tube (L1-7), the sixth windward heat transfer tube (L1-6), and the fifth windward heat transfer tube (L1-5) in this order, and then flows out to the branch pipe (73*a*) of the gas-side header (73). In this manner, in the lower parallel path (85) during a heating operation, a refrigerant flows through the eighth leeward heat transfer tube (L3-8), the eighth intermediate heat transfer tube (L2-8), and the eighth windward heat transfer tube (L1-8) in this order so that counter flow portions (94) are formed locally in the lower parallel path (85). Also, in the lower parallel path (85) during a heating operation, the refrigerant flows from the sixth intermediate heat transfer tube (L2-6) to the sixth leeward heat transfer tube (L3-6), and the refrigerant also flows from the seventh intermediate heat transfer tube (L2-7) to the seventh leeward heat transfer tube (L3-7) so that parallel flow portions (93) are formed locally in the lower parallel path (85).

In this manner, in the parallel paths (84, 85) during a heating operation, the refrigerant flows through the heat transfer tubes (71) of the leeward tube line (L3), the heat transfer tubes (71) of the intermediate tube line (L2), and the heat transfer tubes (71) of the windward tube line (L1) in this order so that counter flow portions (94) are formed. As a result, in the second region (R2), some temperature difference is also ensured between the refrigerant and the air from the windward tube line (L1) through the leeward tube line (L3), and thus a heat exchanger effectiveness increases in the second region (R2).

<Refrigerants Path during Cooling Operation>

In the above-described indoor heat exchanger (32) during a cooling operation, in each of the series paths (81, 82, 83) in the first region (R1), a parallel flow portion (full parallel flow portion (92)) is formed across the three tube lines (L1, L2, L3). Also, in the indoor heat exchanger (32) during a cooling operation, in each of the parallel paths (84, 85) in the second region (R2), both a parallel flow portion (93) and a counter flow portion (94) are formed.

Figure 10:
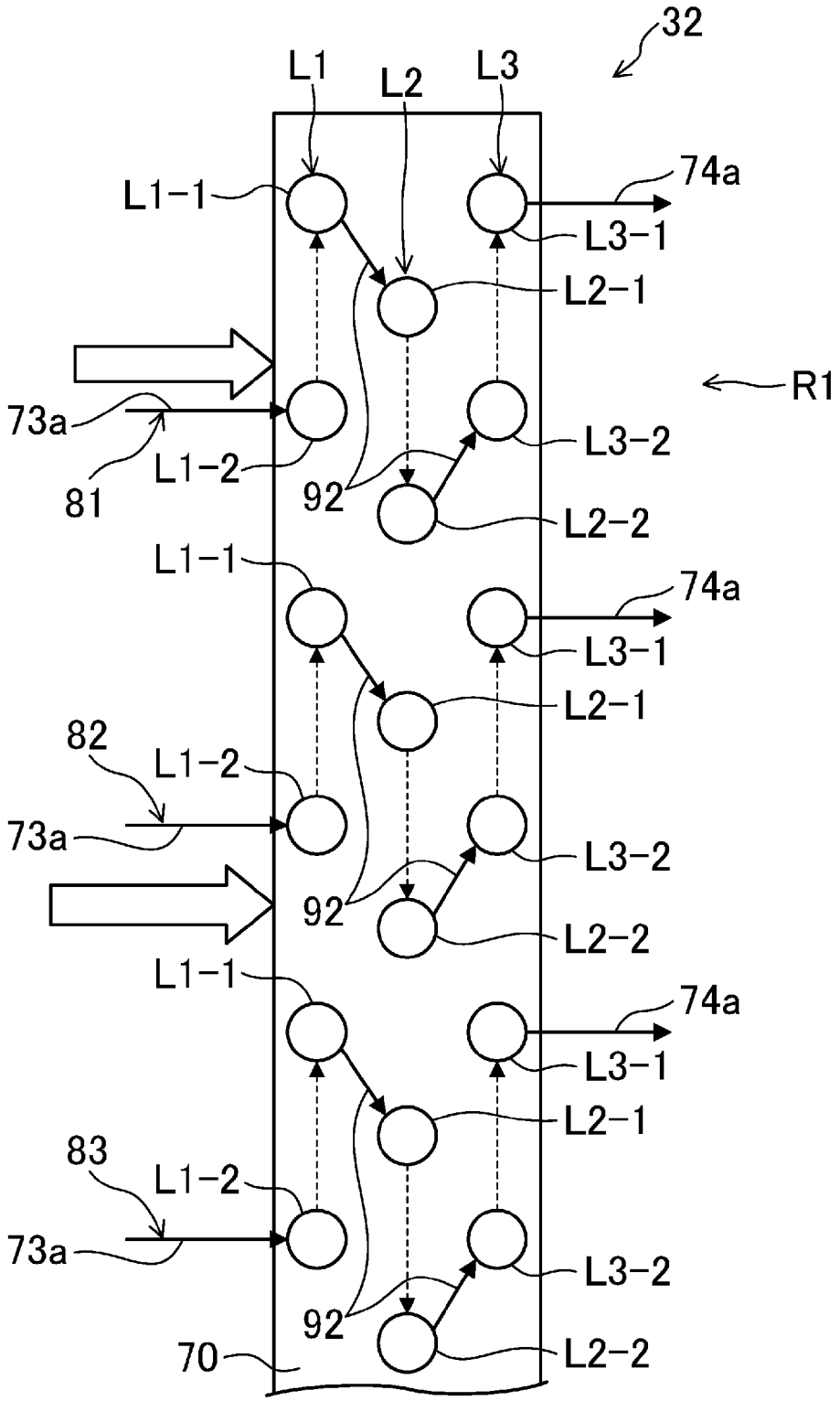
FIG. 10 is a partially enlarged view showing refrigerant paths in a first region of an indoor heat exchanger during a cooling operation according to an embodiment.

Specifically, as illustrated in FIG. 10, in the first region (R1) of the indoor heat exchanger (32) during a cooling operation, a refrigerant that has flowed out of the branch pipe (73*a*) of the gas-side header (73) flows into each of the series paths (81, 82, 83). The refrigerant that has flowed into each of the series paths (81, 82, 83) flows through the second windward heat transfer tube (L1-2), the first windward heat transfer tube (L1-1), the first intermediate heat transfer tube (L2-1), the second intermediate heat transfer tube (L2-2), the second leeward heat transfer tube (L3-2), and the first leeward heat transfer tube (L3-1) in this order, and then flows out to the flow dividing channel (74*a*) of the liquid flow divider (74).

In this manner, in the series paths (81, 82, 83) during a cooling operation, the refrigerant flows through the heat transfer tubes (71) of the windward tube line (L1), the heat transfer tubes (71) of the intermediate tube line (L2), and the heat transfer tubes (71) of the leeward tube line (L3) in this order. Accordingly, in the series paths (81, 82, 83) during a cooling operation, parallel flow portions (full parallel flow portions (92)) are formed over the entire region from the windward end portion through the leeward end portion. The first region (R1) is formed so as to face the blowout passage (72) of the indoor fan (27), and thus the air passing through the fins (70) has a relatively high flow velocity. Accordingly, even if parallel flow portions (92) are formed over the entire first region (R1), some heat exchanger effectiveness is still ensured for the first region (R1).

Figure 11:
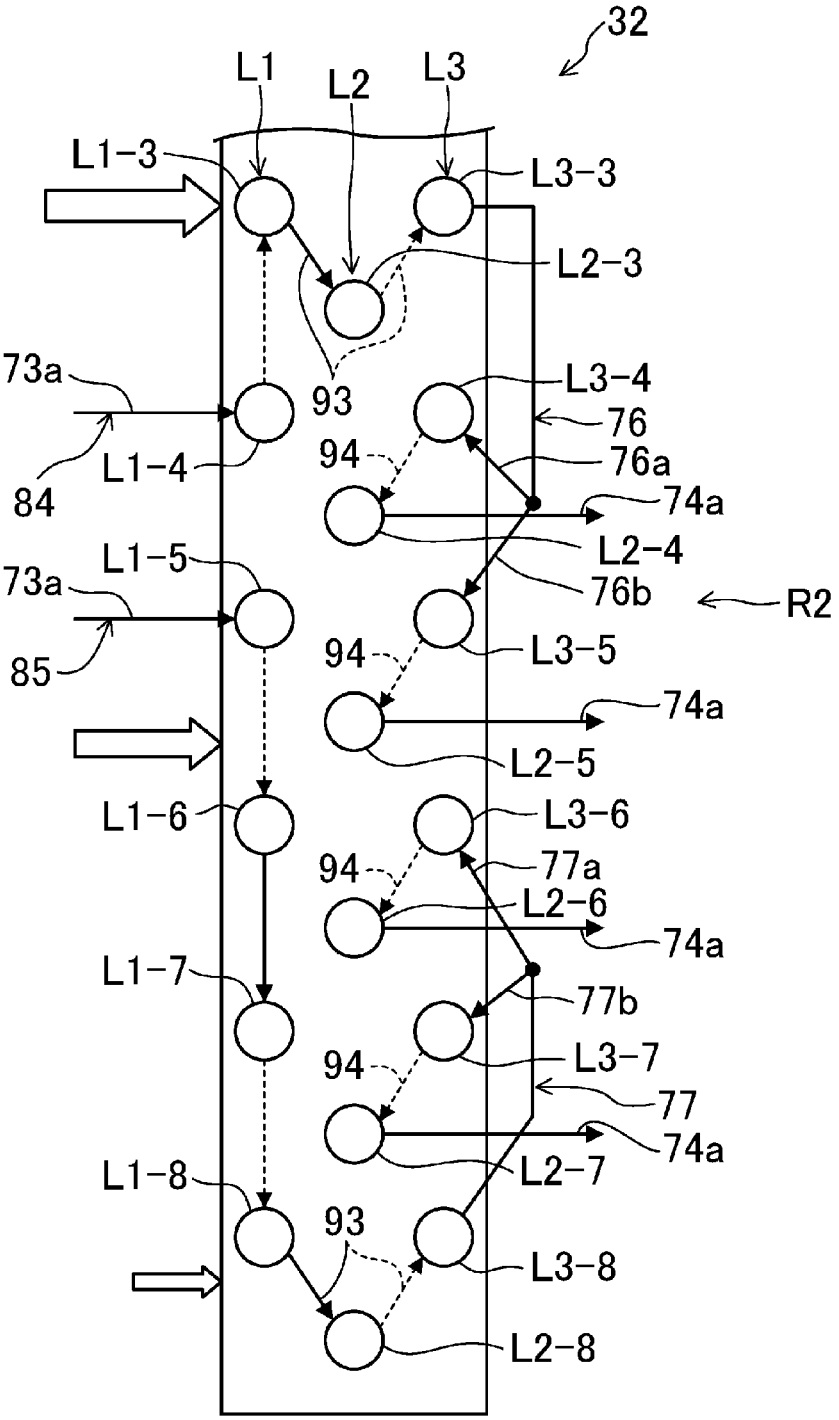
FIG. 11 is a partially enlarged view showing refrigerant paths in a second region of the indoor heat exchanger during a cooling operation according to an embodiment.

Also, as illustrated in FIG. 11, in the second region (R2) of the indoor heat exchanger (32) during a cooling operation, the refrigerant that has flowed out of the branch pipe (73*a*) of the gas-side header (73) flows into each of the upper parallel path (84) and the lower parallel path (85).

In the upper parallel path (84), a refrigerant that has flowed through the branch pipe (73*a*) of the gas-side header (73) flows through the fourth windward heat transfer tube (L1-4), the third windward heat transfer tube (L1-3), the third intermediate heat transfer tube (L2-3), and the third leeward heat transfer tube (L3-3) in this order. The refrigerant that has flowed into to the third leeward heat transfer tube (L3-3) flows into the first flow dividing pipe (76), is divided to the two connecting pipes (76*a*, 76*b*), and then flows out to the fourth leeward heat transfer tube (L3-4) and the fifth leeward heat transfer tube (L3-5). The refrigerant that has flowed into the fourth leeward heat transfer tube (L3-4) flows through the fourth intermediate heat transfer tube (L2-4), and then flows out to the flow dividing channel (74*a*) of the liquid flow divider (74). The refrigerant that has flowed into to the fifth leeward heat transfer tube (L3-5) flows through the fifth intermediate heat transfer tube (L2-5), and then flows out to the flow dividing channel (74*a*) of the liquid flow divider (74). In this manner, in the upper parallel path (84) during a cooling operation, the refrigerant flows through the third windward heat transfer tube (L1-3), the third intermediate heat transfer tube (L2-3), and the third leeward heat transfer tube (L3-3) in this order so that parallel flow portions (93) are formed locally in the upper parallel path (84). Also, in the upper parallel path (84) during a cooling operation, the refrigerant flows from the fourth leeward heat transfer tube (L3-4) toward the fourth intermediate heat transfer tube (L2-4), and the refrigerant also flows from the fifth leeward heat transfer tube (L3-5) toward the fifth intermediate heat transfer tube (L2-5) so that counter flow portions (94) are formed locally in the upper parallel path (84).

In the lower parallel path (85), the refrigerant that has flowed through the branch pipe (73*a*) of the gas-side header (73) flows through the fifth windward heat transfer tube (L1-5), the sixth windward heat transfer tube (L1-6), the seventh windward heat transfer tube (L1-7), the eighth windward heat transfer tube (L1-8), the eighth intermediate heat transfer tube (L2-8), and the eighth leeward heat transfer tube (L3-8) in this order. The refrigerant that has flowed into the eighth leeward heat transfer tube (L3-8) flows into the second flow dividing pipe (77), is divided to the two connecting pipes (77*a*, 77*b*), and then flow out to the sixth leeward heat transfer tube (L3-6) and the seventh leeward heat transfer tube (L3-7). The refrigerant that has flowed into the sixth leeward heat transfer tube (L3-6) flows through the sixth intermediate heat transfer tube (L2-6), and then flow out to the flow dividing channel (74*a*) of the liquid flow divider (74). The refrigerant that has flowed into the seventh leeward heat transfer tube (L3-7) flows through the seventh intermediate heat transfer tube (L2-7) and then flow out to the flow dividing channel (74*a*) of the liquid flow divider (74). In this manner, in the lower parallel path (85) during a cooling operation, the refrigerant flows through the eighth windward heat transfer tube (L1-8), the eighth intermediate heat transfer tube (L2-8), and the eighth leeward heat transfer tube (L3-8) in this order so that parallel flow portions (93) are formed locally in the lower parallel path (85). Also, in the lower parallel path (85) during a cooling operation, the refrigerant flows from the sixth leeward heat transfer tube (L3-6) to the sixth intermediate heat transfer tube (L2-6), and the refrigerant also flows from the seventh leeward heat transfer tube (L3-7) to the seventh intermediate heat transfer tube (L2-7) so that counter flow portions (94) are formed locally in the lower parallel path (85).

In this manner, in the second region (R2) during a cooling operation, counter flow portions (94) are formed from the heat transfer tubes (71) of the leeward tube line (L3) through the heat transfer tubes (71) of the intermediate tube line (L2). Accordingly, the heat transfer between the air and the refrigerant is still promoted and some cooling performance is ensured even in the second region (R2) through which air having a relatively low flow velocity passes.

Advantages of Embodiment

According to the embodiments described above, during a heating operation, full counter flow portions (91) are formed in the series paths (81, 82, 83) in the first region (R1), and partial counter flow portions (94) are formed in each of the parallel paths (84, 85) in the second region (R2). Thus, some temperature difference is ensured more easily between the refrigerant and the air over the entire region. As a result, the indoor heat exchanger (32) achieves a relatively high heating capacity.

Also, according to the embodiments described above, during a cooling operation, partial counter flow portions (94) are formed in the second region (R2) where the air velocity is relatively low. Thus, the heat exchanger effectiveness in the second region (R2) increases more significantly in this case than in a case where the parallel flow portions are formed in the entire second region (R2). As a result, during a cooling operation, the heat transfer between the refrigerant and the air is promoted in the second region (R2), and the cooling performance is improvable.

Also, according to the embodiments described above, flow dividing pipes (76, 77) are provided for the parallel paths (84, 85) in the second region (R2), and some of the heat transfer tubes (71) are connected in parallel. Thus, compared to the configuration in which the heat transfer tubes (71) are connected in series together, this configuration allows for reducing the pressure loss in the refrigerant flow channel and saving the power to be dissipated by the compressor (12). Also, a larger number of heat transfer tubes (71) may be connected in the second region (R2) than in the first region (R1) to form a refrigerant path. That is, even in the second region (R2) where the air has a low flow velocity, adequate heat exchanger effectiveness is achievable. Furthermore, in the parallel paths (84, 85), the refrigerant is prevented from drifting to any of the series paths (81, 82, 83) in the first region (R1) by reducing the pressure loss in the refrigerant flow channel.

<<Other Embodiments>>

The embodiment described above may have any of the following alternative configurations.

In the embodiment described above, the present invention uses an indoor heat exchanger (32) including three tube lines (L1, L2, L3). However, the present invention may also use an indoor heat exchanger (32) having four or more tube lines.

Also, in the indoor heat exchanger (32) according to the embodiment described above, three refrigerant paths (81, 82, 83) (first refrigerant paths) are supposed to be formed in the first region (R1), and two refrigerant paths (84, 85) (second refrigerant paths) are supposed to be formed in the second region (R2). However, the number of the first refrigerant paths to provide may be one, two, or four or more, and the number of the second refrigerant paths to provide may be one, or three or more.

Also, the indoor unit (20) of the air conditioning device (10) according to the above embodiment is configured as a ceiling mounted indoor unit fitted into an opening (O) of a ceiling (U). However, the indoor unit (20) may be configured as a ceiling suspended indoor unit suspended from the ceiling and arranged in the room space (R).

INDUSTRIAL APPLICABILITY

As can be seen from the foregoing, the present invention is useful for a refrigerant path in an indoor heat exchanger of an indoor unit for an air conditioning device.

DESCRIPTION OF REFERENCE CHARACTERS

10 Air Conditioning Device
20 Indoor Unit
27 Indoor Fan
32 Indoor Heat Exchanger
36 Drain Pan
70 Fin
71 Heat Transfer Tube
76 First Flow Dividing Pipe (Flow Dividing Portion)
77 Second Flow Dividing Pipe (Flow Dividing Portion)
81 Upper Series Path (First Refrigerant Path)
82 Intermediate Series Path (First Refrigerant Path)
83 Lower Series Path (First Refrigerant Path)
84 Upper Parallel Path (Second Refrigerant Path)
85 Lower Parallel Path (Second Refrigerant Path)
91 Counter Flow Portion (Full Counter Flow Portion)
92 Parallel Flow Portion (Full Parallel Flow Portion)
93 Parallel Flow Portion (Partial Parallel Flow Portion)
94 Counter Flow Portion (Partial Counter Flow Portion)
L1 Windward Tube Line
L2 Intermediate Tube Line
L3 Leeward Tube Line
R1 First Region
R2 Second Region

The invention claimed is:

1. An indoor unit, provided for a ceiling, for an air conditioning device which selectively performs a cooling operation and a heating operation, the indoor unit comprising: an indoor fan; and an indoor heat exchanger which is disposed around the indoor fan and through which air carried by the indoor fan passes, wherein the indoor heat exchanger includes a plurality of fins and heat transfer tubes running through the fins, the indoor heat exchanger includes a plurality of tube lines, the number of which is at least three and in which the heat transfer tubes are arranged side by side in a direction that intersects with an airflow direction, and the indoor heat exchanger has a first region and a second region, the first region including a first refrigerant path which forms during the heating operation, a full counter flow portion in which a refrigerant flows sequentially from a tube line located most downstream in the airflow direction toward a tube line located most upstream in the airflow direction, and during the cooling operation, a full parallel flow portion in which the refrigerant flows sequentially from the tube line located most upstream in the airflow direction toward the tube line located most downstream in the airflow direction, the second region being configured so that air has a lower flow velocity in the second region than in the first region and including a second refrigerant path which forms, during both the cooling and heating operations, both a partial parallel flow portion in which the refrigerant flows from a heat transfer tube in any particular one of the plurality of tube lines to a heat transfer tube in another tube line located downstream of the particular tube line in the airflow direction, and a partial counter flow portion in which the refrigerant flows from a heat transfer tube in any particular one of the plurality of tube lines to a heat transfer tube in another tube line located upstream of the particular tube line in the airflow direction, the second refrigerant path is formed so that a total number of the heat transfer tubes through which the refrigerant flows in the second refrigerant path is larger than that of the heat transfer tubes through which the refrigerant flows in the first refrigerant path, and during the cooling operation, the second refrigerant path forms a flow dividing portion that divides the refrigerant flowed out of the partial parallel flow portion into a plurality of partial counter flow portions including the partial counter flow portion.

2. The indoor unit for the air conditioning device of claim 1, wherein the first refrigerant path includes a series path that does not divide the refrigerant.

3. The indoor unit for the air conditioning device of claim 1, wherein the plurality of tube lines comprise a windward tube line located most upstream in the airflow direction, a leeward tube line located most downstream in the airflow direction, and an intermediate tube line located between the windward tube line and the leeward tube line, the first refrigerant path forms, during the heating operation, the full counter flow portion in which the refrigerant flows through the heat transfer tube of the leeward tube line, the heat transfer tube of the intermediate tube line, and the heat transfer tube of the windward tube line in this order, and the first refrigerant path forms, during the cooling operation, the full parallel flow portion in which the refrigerant flows through the heat transfer tube of the windward tube line, the heat transfer tube of the intermediate tube line, and the heat transfer tube of the leeward tube line in this order, the second refrigerant path forms, during the heating operation, both of the partial parallel flow portion in which the refrigerant flows from the heat transfer tube of the intermediate tube line toward the heat transfer tube of the leeward tube line, and the partial counter flow portion in which the refrigerant flows through the heat transfer tube of the leeward tube line, the heat transfer tube of the intelinediate tube line, and the heat transfer tube of the windward tube line in this order, the second refrigerant path forms, during the cooling operation, both the partial parallel flow portion in which the refrigerant flows through the heat transfer tube of the windward tube line, the heat transfer tube of the intermediate tube line, and the heat transfer tube of the leeward tube line in this order, and the partial counter flow portion in which the refrigerant flows from the heat transfer tube of the leeward tube line toward the heat transfer tube of the intermediate tube line, and the refrigerant, during the cooling operation, flows out of the heat transfer tube of the intermediate tube line.

4. The indoor unit for the air conditioning device of claim 1, wherein a drain pan is disposed under the indoor heat exchanger, and at least part of the second region of the indoor heat exchanger is located inside the drain pan.

5. The indoor unit for the air conditioning device of claim 2, wherein the plurality of tube lines comprise a windward tube line located most upstream in the airflow direction, a leeward tube line located most downstream in the airflow direction, and an intermediate tube line located between the windward tube line and the leeward tube line, the first refrigerant path forms, during the heating operation, the full counter flow portion in which the refrigerant flows through the heat transfer tube of the leeward tube line, the heat transfer tube of the intermediate tube line, and the heat transfer tube of the windward tube line in this order, and the first refrigerant path forms, during the cooling operation, the full parallel flow portion in which the refrigerant flows through the heat transfer tube of the windward tube line, the heat transfer tube of the intermediate tube line, and the heat transfer tube of the leeward tube line in this order, the second refrigerant path forms, during the heating operation, both of the partial parallel flow portion in which the refrigerant flows from the heat transfer tube of the intermediate tube line toward the heat transfer tube of the leeward tube line, and the partial counter flow portion in which the refrigerant flows through the heat transfer tube of the leeward tube line, the heat transfer tube of the intermediate tube line, and the heat transfer tube of the windward tube line in this order, the second refrigerant path forms, during the cooling operation, both the partial parallel flow portion in which the refrigerant flows through the heat transfer tube of the windward tube line, the heat transfer tube of the intermediate tube line, and the heat transfer tube of the leeward tube line in this order, and the partial counter flow portion in which the refrigerant flows from the heat transfer tube of the leeward tube line toward the heat transfer tube of the intermediate tube line, and the refrigerant, during the cooling operation, flows out of the heat transfer tube of the intermediate tube line.

6. The indoor unit for the air conditioning device of claim 2, wherein a drain pan is disposed under the indoor heat exchanger, and at least part of the second region of the indoor heat exchanger is located inside the drain pan.

7. The indoor unit for the air conditioning device of claim 3, wherein a drain pan is disposed under the indoor heat exchanger, and at least part of the second region of the indoor heat exchanger is located inside the drain pan.

* * * * *